US008805246B2

(12) United States Patent
Suzuki et al.

(10) Patent No.: US 8,805,246 B2
(45) Date of Patent: Aug. 12, 2014

(54) TONER REPLENISHING DEVICE AND IMAGE FORMING APPARATUS INCLUDING TONER REPLENISHING DEVICE

(75) Inventors: Yuji Suzuki, Tokyo (JP); Eisuke Hori, Tokyo (JP); Nobuo Takami, Kanagawa (JP); Kenji Kikuchi, Kanagawa (JP); Hideki Kimura, Kanagawa (JP); Noriyuki Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 224 days.

(21) Appl. No.: 13/032,108

(22) Filed: Feb. 22, 2011

(65) Prior Publication Data

US 2011/0222871 A1 Sep. 15, 2011

(30) Foreign Application Priority Data

Mar. 15, 2010 (JP) ..... 2010-057731
Dec. 2, 2010 (JP) ..... 2010-269644

(51) Int. Cl.
*G03G 15/08* (2006.01)

(52) U.S. Cl.
CPC ..... *G03G 15/0889* (2013.01); *G03G 15/086* (2013.01); *G03G 15/0891* (2013.01)
USPC ..... 399/254; 399/27; 399/61

(58) Field of Classification Search
CPC ..... G03G 15/086; G03G 15/0889
USPC ..... 399/27, 61
See application file for complete search history.

(56) References Cited

U.S. PATENT DOCUMENTS

| | | | | |
|---|---|---|---|---|
| 5,307,129 | A * | 4/1994 | Miura et al. | 399/263 |
| 5,526,100 | A * | 6/1996 | Misago et al. | 399/29 |
| 5,537,197 | A | 7/1996 | Fujishiro et al. | |
| 5,565,973 | A | 10/1996 | Fujishiro et al. | |
| 5,655,193 | A | 8/1997 | Fujishiro et al. | |
| 6,442,364 | B2 | 8/2002 | Kai et al. | |
| 7,043,182 | B2 | 5/2006 | Sakai et al. | |
| 7,248,824 | B2 | 7/2007 | Takami | |
| 7,389,071 | B2 | 6/2008 | Katsuyama et al. | |
| 7,457,564 | B2 | 11/2008 | Takami | |
| 7,769,316 | B2 | 8/2010 | Kimura | |

(Continued)

FOREIGN PATENT DOCUMENTS

| | | |
|---|---|---|
| JP | 07-043998 | 2/1995 |
| JP | 07-128972 | 5/1995 |

(Continued)

OTHER PUBLICATIONS

U.S. Appl. No. 12/879,366, filed Sep. 10, 2010, Noriyuki Kimura.

(Continued)

*Primary Examiner* — Benjamin Schmitt
(74) *Attorney, Agent, or Firm* — Oblon, Spivak, McClelland, Maier & Neustadt, L.L.P.

(57) ABSTRACT

A toner replenishing device includes a sub hopper (toner container), a toner detection sensor, an agitator, and a paddle. The sub hopper contains toner. The toner detection sensor is located on a wall surface in the sub hopper and detects whether toner remains at a height at which it is located. The agitator rotates in the sub hopper to clean the detection surface of the toner detection sensor. The paddle serves as a toner collecting unit that collects toner to the vicinity of the detection surface of the toner detection sensor in the sub hopper.

14 Claims, 16 Drawing Sheets

(56) References Cited

U.S. PATENT DOCUMENTS

| | | | | |
|---|---|---|---|---|
| 7,787,784 | B2 | 8/2010 | Hori | |
| 7,813,680 | B2 | 10/2010 | Masuda et al. | |
| 2005/0089338 | A1* | 4/2005 | Hoshi et al. | 399/27 |
| 2006/0051136 | A1* | 3/2006 | Tsuda et al. | 399/258 |
| 2007/0071502 | A1* | 3/2007 | Shimizu | 399/258 |
| 2009/0245882 | A1 | 10/2009 | Ozeki et al. | |
| 2009/0245889 | A1 | 10/2009 | Koetsuka et al. | |
| 2009/0297178 | A1* | 12/2009 | Kakuta et al. | 399/27 |
| 2010/0003055 | A1 | 1/2010 | Kikuchi et al. | |
| 2010/0111572 | A1 | 5/2010 | Hori et al. | |
| 2010/0129118 | A1 | 5/2010 | Kimura et al. | |

FOREIGN PATENT DOCUMENTS

| | | | | |
|---|---|---|---|---|
| JP | 07-175372 | | 7/1995 | |
| JP | 07306580 | A * | 11/1995 | G03G 15/08 |
| JP | 8-110695 | | 4/1996 | |
| JP | 2004-139031 | | 5/2004 | |
| JP | 2007-108631 | | 4/2007 | |
| JP | 2007-240795 | | 9/2007 | |
| JP | 4294464 | | 4/2009 | |

OTHER PUBLICATIONS

Office Action issued on Jun. 11, 2012 in the corresponding Chinese Patent Application No. 201110061505.5 (with English Translation).

* cited by examiner

TONER REPLENISHING DEVICE AND IMAGE FORMING APPARATUS INCLUDING TONER REPLENISHING DEVICE

CROSS-REFERENCE TO RELATED APPLICATIONS

The present application claims priority to and incorporates by reference the entire contents of Japanese Patent Application No. 2010-057731 filed in Japan on Mar. 15, 2010 and Japanese Patent Application No. 2010-269644 filed in Japan on Dec. 2, 2010.

BACKGROUND OF THE INVENTION

1. Field of the Invention

The present invention relates to a toner replenishing device and an image forming apparatus including the toner replenishing device.

2. Description of the Related Art

Japanese Patent Application Laid-open No. 2004-139031 discloses a conventional toner replenishing device, in which toner supplied from a toner bottle is temporarily housed in a toner container. Then, the toner in the toner container is supplied to a developer container of a developing unit that performs development by a toner replenishing conveying member. The toner replenishing conveying member rotates to convey the toner in the toner container.

A main object of the replenishment of toner in the above toner replenishing device is to replenish an amount of toner that has been consumed by image outputting to keep toner density in the developer container of the developing unit. However, if an amount of toner in the toner container of the toner replenishing device becomes smaller and a stable amount of toner cannot be supplied, toner density in the developer container of the developing unit is lowered. This causes formation of an image of which image density is lowered.

The conventional toner replenishing device includes a toner detection sensor that detects whether toner remains at a certain height in the toner container. The toner replenishing device can detect reduction of toner in the toner container based on a detection result of the toner detection sensor. Therefore, the toner replenishing device can detect a state where a toner bottle is empty but toner in the toner container remains (hereinafter, referred to as "near empty"). The toner bottle can be replaced before toner in the toner container is completely consumed by replacing the toner bottle in the near empty state. Therefore, toner can be stably replenished. This can prevent image density from being lowered because of the lowered toner density in the developer container.

Japanese Patent Application Laid-open No. 2004-220012 discloses an image forming apparatus including another conventional toner replenishing device. The conventional toner replenishing device includes a toner agitation member that rotates to agitate toner in a toner container that temporarily contains the toner so that the toner does not aggregate in the toner container. In the toner replenishing device, driving force is supplied to a toner replenishing conveying member and the toner agitation member from a common toner replenishing operation driving source through gears.

The recent increase in the image formation speed indicates a need to increase the speed of toner replenishment from the toner replenishing device per hour. If the number of revolutions of the toner replenishing conveying member is increased to increase the speed of toner replenishment, the number of revolutions of the toner agitation member of which driving source is common to that of the toner replenishing conveying member is also increased. Besides, toner having excellent flowability (low accelerated aggregation degree) is used to respond to the increase in the image formation speed. Therefore, if the toner is excessively agitated by the toner agitation member, air excessively mixes into the toner, so that the toner is made in a floating state. If the toner is made in the floating state, an amount of toner per unit volume becomes small and a toner detection sensor cannot detect that toner remains. In particular, when a type of sensor that detects whether toner remains based on the size of a load applied onto a detection surface of the sensor, for example, a sensor of a piezoelectric vibration type is used, if the toner is made in the floating state as described above, the load applied onto the detection surface becomes small. Accordingly, the sensor makes erroneous detection that toner does not remain in the toner container although toner remains therein.

The toner detection sensor of the above piezoelectric vibration type is a sensor that detects whether a load is applied using the following principle. In the toner detection sensor, electrodes are provided on both surfaces of a plate-like piezoelectric ceramics. Then, if a load is applied in a state where an alternate signal is applied to the electrodes on both surfaces thereof to oscillate the electrodes, phase characteristics thereof change. When the toner detection sensor is used to detect a toner remaining amount in the toner container, one of the electrodes on both surfaces is set to be a detection surface. The toner detection sensor is arranged on a wall portion of the toner container such that the electrode faces an inner side. Then, toner is made direct contact with the detection surface to detect whether toner remains. Since the toner detection sensor has high sensitivity, if toner is kept adhered to the detection surface, the toner detection sensor makes erroneous detection that toner remains in the toner container although toner does not remain therein. The toner detection sensor makes such erroneous detection because the sensor detects the toner adhered to the detection surface. Therefore, it is desirable that the detection surface is regularly cleaned to scrape off the toner adhered to the detection surface.

In recent years, there is the need for reduction of a toner replenishing device in size in addition to an increase in the image formation speed. To reduce the device in size, a space occupied by each component that constitutes the device is required to be saved. Therefore, a space occupied by a toner container is also required to be saved. If the space occupied by the toner container is saved to reduce the device in size, the capacity of the toner container becomes smaller so that a toner volume housed therein is also reduced.

The present inventors used a toner detection sensor of the above-described piezoelectric vibration type to detect a toner remaining amount in a toner container of which capacity is smaller than that of the conventional one. Then, the inventors found that the sensor made erroneous detection that toner does not remain if toner remains in some cases. Furthermore, it was found that the erroneous detection possibly occurs not only in the above piezoelectric vibration type sensor that detects a load applied onto a detection surface of the sensor but in sensors of other types whose detection surface is desirably regularly cleaned to scrape off toner adhered to the detection surface. The sensors of other types include a detection sensor of a magnetic permeability detection type and a detection sensor of a transmitted light detection type, for example.

It is therefore an object of the present invention to provide a toner replenishing device capable of detecting a toner remaining amount accurately even if the capacity of a toner container is smaller than that of the conventional one when a detection surface of a toner detection sensor that detects the toner remaining amount in the toner container is cleaned and to provide an image forming apparatus including the toner replenishing device.

SUMMARY OF THE INVENTION

It is an object of the present invention to at least partially solve the problems in the conventional technology.

According to an aspect of the invention, a toner replenishing device includes a toner container, a toner detection sensor, a detection surface cleaning member, and a toner collecting unit. The toner container contains toner. The toner detection sensor is located on a wall surface in the toner container and detects whether the toner remains at a height at which it is located. The detection surface cleaning member rotates in the toner container and cleans a detection surface of the toner detection sensor. The toner collecting unit collects toner to the vicinity of the detection surface of the toner detection sensor in the toner container.

According to another aspect of the invention, an image forming apparatus includes a latent image carrier, a developing unit, and a toner replenishing device. The developing unit develops a latent image on the latent image carrier with developer in a developer container. The toner replenishing device supplies toner to the developer container. The toner replenishing device includes a toner container, a toner detection sensor, a detection surface cleaning member, and a toner collecting unit. The toner container contains toner. The toner detection sensor is located on a wall surface in the toner container and detects whether the toner remains at a height at which it is located. The detection surface cleaning member rotates in the toner container and cleans a detection surface of the toner detection sensor. The toner collecting unit collects toner to the vicinity of the detection surface of the toner detection sensor in the toner container.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described in detail below with reference to the accompanying drawings. In the following, an electrophotographic printer (hereinafter, simply referred to as "printer") 100 is described as an image forming apparatus according to a first embodiment.

Figure 1:
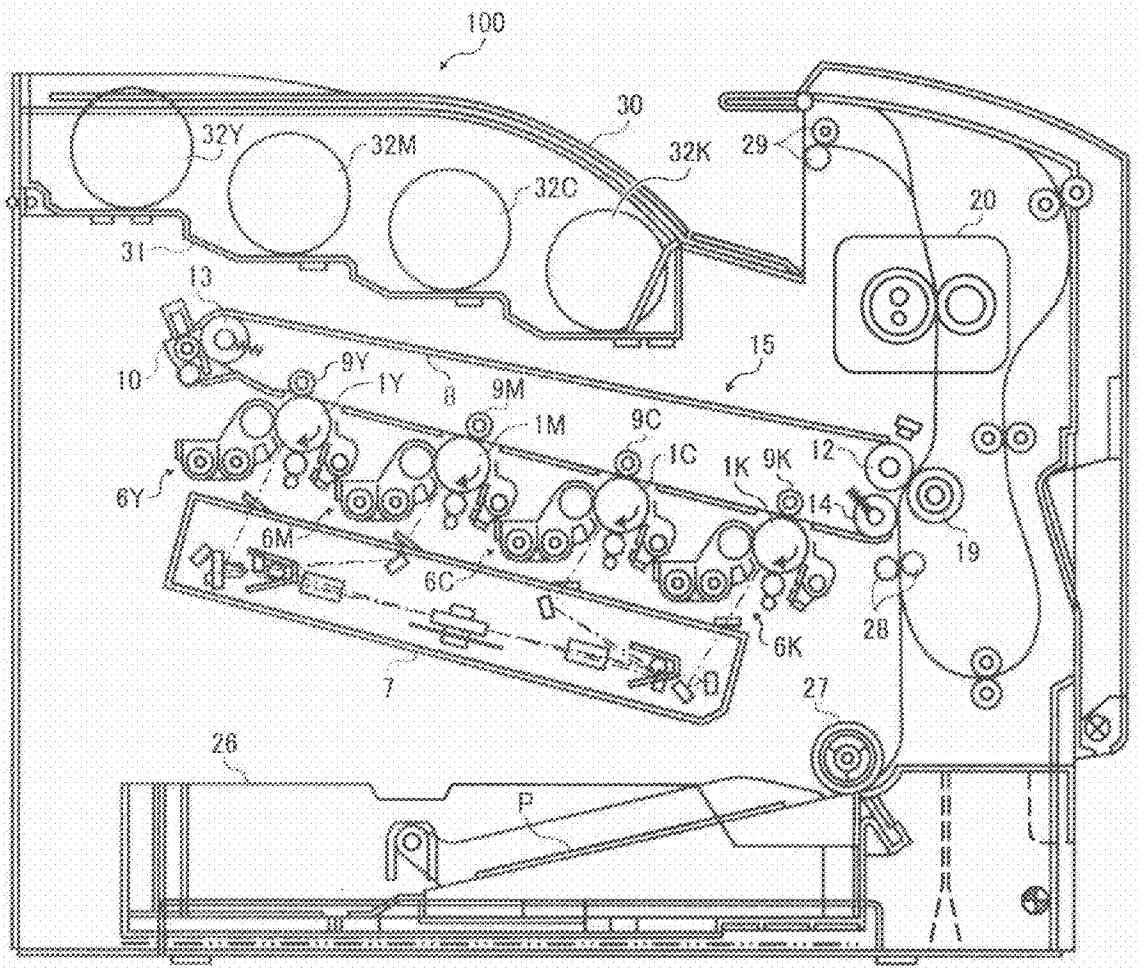
FIG. 1 is a schematic view illustrating a configuration of a printer according to an embodiment.
Figure 2:
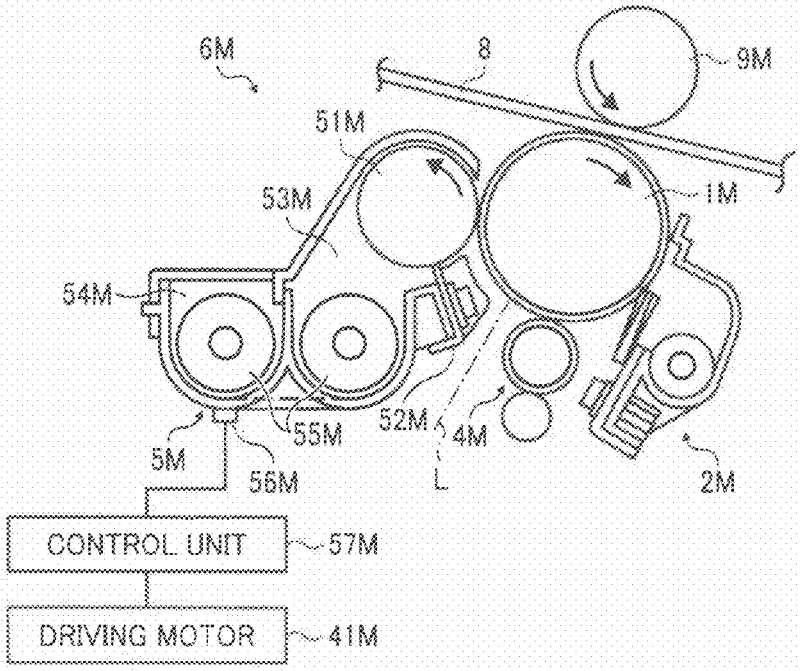
FIG. 2 is an enlarged view illustrating a configuration in the vicinity of a process cartridge.

First, a basic configuration of the printer 100 is described. FIG. 1 is a schematic view illustrating the configuration of the printer 100. In FIG. 1, the printer 100 includes four process cartridges 6Y, M, C, K for generating toner images of yellow, magenta, cyan, and black (hereinafter, expressed by Y, M, C, K). These four process cartridges 6Y, M, C, K use Y, M, C, K toners of which colors are different from each other as image formation materials but other configurations thereof are the same. The four process cartridges 6Y, M, C, K are replaced when reaching the end of their lives. The process cartridge 6M for generating an M toner image is taken for example. The process cartridge 6M includes a drum-like photosensitive element 1M, a drum cleaning device 2M, a neutralization apparatus (not illustrated), a charging unit 4M, a developing unit 5M, and the like as illustrated in FIG. 2. The process cartridge 6M is detachably attached to a main body of the printer 100 and is configured such that consumable parts can be replaced at a time.

The charging unit 4M uniformly charges a surface of the photosensitive element 1M that rotates in the clockwise direction in FIG. 1 by a driving unit (not illustrated). The surface of the photosensitive element 1M, which has been uniformly charged, is exposure-scanned with laser beam L to carry an electrostatic latent image for M. The electrostatic latent image for M is developed to an M toner image by the developing unit 5M using M toner. Then, the M toner image is intermediately transferred onto an intermediate transfer belt 8. The drum cleaning device 2M removes toner remaining on the surface of the photosensitive element 1M after the intermediate transfer processing. Furthermore, the neutralization apparatus removes residual charge of the photosensitive element 1M after cleaned. The surface of the photosensitive element 1M is initialized with the neutralization to prepare for a subsequent image formation. In other process cartridges 6Y, C, K, Y, C, K toner images are formed on photosensitive elements 1Y, C, K, respectively to be intermediately transferred onto the intermediate transfer belt 8 in the same manner.

In FIG. 1 as previously illustrated, an exposure unit 7 is arranged on the lower side of the process cartridges 6Y, M, C, K. The exposure unit 7 as a latent image forming unit irradiates each of the photosensitive elements in the process cartridges 6Y, M, C, K with the laser beam L emitted based on image information to expose each of the photosensitive elements thereto. Electrostatic latent images for Y, M, C, K are formed on the photosensitive elements 1Y, M, C, K with the exposure. It is to be noted that the exposure unit 7 irradiates each of the photosensitive elements with the laser beam L emitted from a light source through a plurality of optical lenses and mirrors while scanning each of the photosensitive elements with a polygon mirror that is rotationally driven by a motor.

Sheet cassettes 26 and a sheet feeding unit are arranged on the lower side of the exposure unit 7 in FIG. 1. The sheet feeding unit includes a sheet feeding roller 27 incorporated in the sheet cassettes 26, a pair of registration rollers 28, and the like. The sheet cassettes 26 accommodate a plurality of transfer sheets P as recording media in a staked manner. The sheet feeding roller 27 abuts against the uppermost transfer sheet P on each sheet cassette 26. If the sheet feeding roller 27 is rotated in the counterclockwise direction in FIG. 1 by a driving unit (not illustrated), the uppermost transfer sheet P is fed to between rollers of the pair of registration rollers 28. Both rollers of the pair of registration rollers 28 rotationally drives to nip the transfer sheet P. Rotation of both rollers is stopped once immediately after both rollers nip the transfer sheet P. Then, both rollers feed the transfer sheet P to a secondary transfer nip, which will be described later, at an appropriate timing. In the sheet feeding unit having such configuration, a conveying unit is configured by combinations of the sheet feeding roller 27 and the pair of registration rollers 28 as a timing roller pair. The conveying unit conveys the transfer sheet P to the secondary transfer nip, which will be described later, from the sheet cassette 26 as an accommodation unit.

An intermediate transfer unit 15 is arranged on the upper side of the process cartridges 6Y, M, C, K as illustrated in FIG. 1. The intermediate transfer unit 15 moves the intermediate transfer belt 8 as an intermediate transfer member in an endless manner while stretching the intermediate transfer belt 8. The intermediate transfer unit 15 includes four primary transfer bias rollers 9Y, M, C, K, a cleaning unit 10, and the like in addition to the intermediate transfer belt 8. Furthermore, the intermediate transfer unit 15 includes a secondary transfer backup roller 12, a cleaning backup roller 13, a tension roller 14, and the like. The intermediate transfer belt 8 moves in an endless manner in the counterclockwise direction in FIG. 1 by rotational driving of at least one of these three rollers while being stretched by the three rollers. The primary transfer bias rollers 9Y, M, C, K nip the intermediate transfer belt 8 that moves in an endless manner as described above with the photosensitive elements 1Y, M, C, K to form primary transfer nips. These primary transfer bias rollers 9Y, M, C, K are a type of rollers each of which applies a transfer bias having a polarity (for example, positive) opposite to toner to a back surface (loop inner circumferential surface) of the intermediate transfer belt 8. All of rollers other than the primary transfer bias rollers 9Y, M, C, K are electrically grounded. Y, M, C, K toner images on the photosensitive elements 1Y, M, C, K are primarily transferred to be superimposed on one another. To be more specific, the Y, M, C, K toner images are primarily transferred in a process where the intermediate transfer belt 8 sequentially passes through the primary transfer nips for Y, M, C, K while moving in an endless manner. With the primary transfer, a toner image on which images of four colors are superimposed on one another (hereinafter, referred to as "four-color toner image") is formed on the intermediate transfer belt 8.

The above secondary transfer backup roller 12 nips the intermediate transfer belt 8 with a secondary transfer roller 19 to form a secondary transfer nip. The four-color toner image formed on the intermediate transfer belt 8 is transferred onto the transfer sheet P on the secondary transfer nip. Transfer residual toner that has not been transferred onto the transfer sheet P is adhered to the intermediate transfer belt 8 after having passed through the secondary transfer nip. The intermediate transfer belt 8 to which transfer residual toner has been adhered is cleaned by the cleaning unit 10.

The transfer sheet P is nipped between the intermediate transfer belt 8 and the secondary transfer roller 19 on the secondary transfer nip to be conveyed in the direction opposite to the side of the above pair of registration rollers 28. The intermediate transfer belt 8 and the secondary transfer roller 19 move on surfaces of each other in the forward direction. The four-color toner image that has been transferred onto a surface of the transfer sheet P is fixed onto the transfer sheet P fed from the secondary transfer nip. To be more specific, the four-color toner image is fixed onto the transfer sheet P with heat and pressure when the transfer sheet P passes through between rollers of a fixing unit 20. Thereafter, the transfer sheet P is discharged to the outside of the apparatus after passing through between a pair of ejecting rollers 29. A stack portion 30 is formed on an upper face of the main body of the printer 100. The transfer sheet P discharged to the outside of the apparatus by the pair of ejecting rollers 29 is sequentially stacked on the stack portion 30.

A configuration of the developing unit 5M in the process cartridge 6M is described. The developing unit 5M includes a magnetic field generation unit therein. The developing unit 5M further includes a developing sleeve 51M and a doctor 52M. The developing sleeve 51M serves as a developer carrier that carries a two-component developer containing magnetic particles and toner on a surface thereof to convey the two-component developer. The doctor 52M serves as a developer restriction member that restricts a layer thickness of the developer that is carried on and conveyed by the developing sleeve 51M. The developing sleeve 51M is housed in a developing sleeve housing unit 53M. Adjacent to the developing sleeve housing unit 53M is a developer container 54M that contains the developer. The developer container 54M includes developer conveying screws 55M for agitating and conveying developer. The developing unit 5M includes a density detection sensor 56M and a toner replenishing port (not illustrated). The density detection sensor 56M serves as a toner density sensor that detects toner density of developer in the developer container 54M. The toner replenishing port is a port through which toner to be replenished based on a detection result by the density detection sensor 56M is taken into the developer container 54M.

Operations of the developing unit will now be described. The developer is agitated and conveyed to circulate in the developer container 54M when the developer conveying screws 55M rotate. If the developer is agitated and conveyed, toner in the developer is charged with triboelectric charging against a carrier. The developer containing charged toner in the developer container 54M on the side adjacent to the developing sleeve housing unit 53M is supplied to a surface of the developing sleeve 51M having a magnetic pole therein and is carried by the surface of the developing sleeve 51M with magnetic force. A developer layer carried by the developing sleeve 51M is conveyed in an arrow direction when the developing sleeve 51M rotates. On the way of the conveyance, a layer thickness of the developer layer is restricted by the doctor 52M. Thereafter, the developer layer is conveyed to a developing region opposed to the photosensitive element 1M. Development based on a latent image formed on the photosensitive element 1M is performed on the developing region. The developer layer that has passed through the developing region and has remained on the developing sleeve 51M is conveyed with the rotation of the developing sleeve 51M. Then, the developer layer is separated from the developing sleeve 51M with repulsive magnetic force generated by magnetic pole arrangement in the developing sleeve 51M to be contained in the developer container 54M.

In FIG. 1 as previously illustrated, a toner bottle base 31 as a toner bottle housing unit is arranged between the intermediate transfer unit 15 and the stack portion 30 located on the upper side of the intermediate transfer unit 15. The toner bottle base 31 accommodates toner bottles 32Y, M, C, K containing Y, M, C, K toners, respectively. The toner bottles 32Y, M, C, K are arranged on the toner bottle base 31 for each toner color to be placed thereon from the upper side. Y, M, C, K toners in the toner bottles 32Y, M, C, K are appropriately replenished to the developing units of the process cartridges 6Y, M, C, K, respectively, by toner replenishing devices, which will be described later. These toner bottles 32Y, M, C, K are detachably attached to the main body of the printer 100 independently of the process cartridges 6Y, M, C, K.

Figure 3:
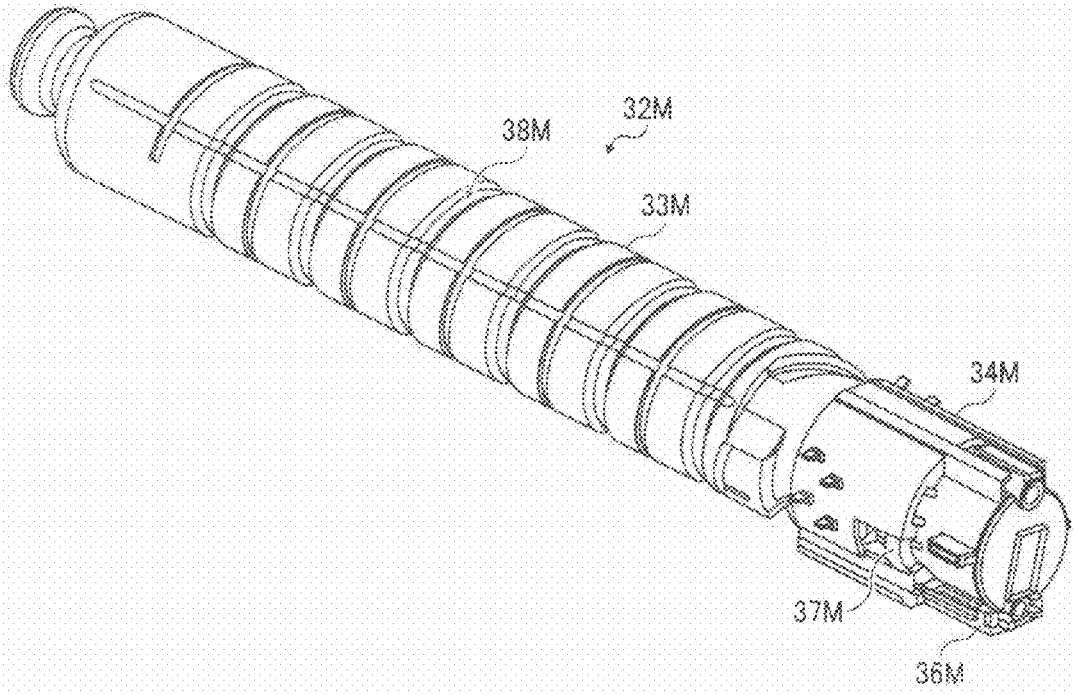
FIG. 3 is a perspective view of a toner bottle.

FIG. 3 is a perspective view of the toner bottle 32M. As illustrated in FIG. 3, the toner bottle 32M has a resin case 34M provided on a tip of a bottle main body 33M. Furthermore, a bottle rotation gear 37M that rotates integrally with the bottle main body 33M is provided on the bottle main body 33M on the side of the resin case 34M.

When the toner bottle 32M is attached to the main body of the printer 100, a shutter 36M moves and opens by inserting the toner bottle 32M into the main body of the printer 100, and a toner discharge port (not illustrated) is opened. At the same time, the resin case 34M and the toner bottle base 31 are coupled to each other to be fixed. On the other hand, when the toner bottle 32M is detached from the main body of the printer 100, coupling of the toner bottle 32M and the toner bottle base 31 is released by pulling the toner bottle 32M out of the main body of the printer 100. At the same time, the shutter 36M closes, and the toner discharge port is closed. Then, the toner bottle 32M can be taken out from the main body of the printer 100 directly.

Next, a toner conveying unit is described.

Figure 4:
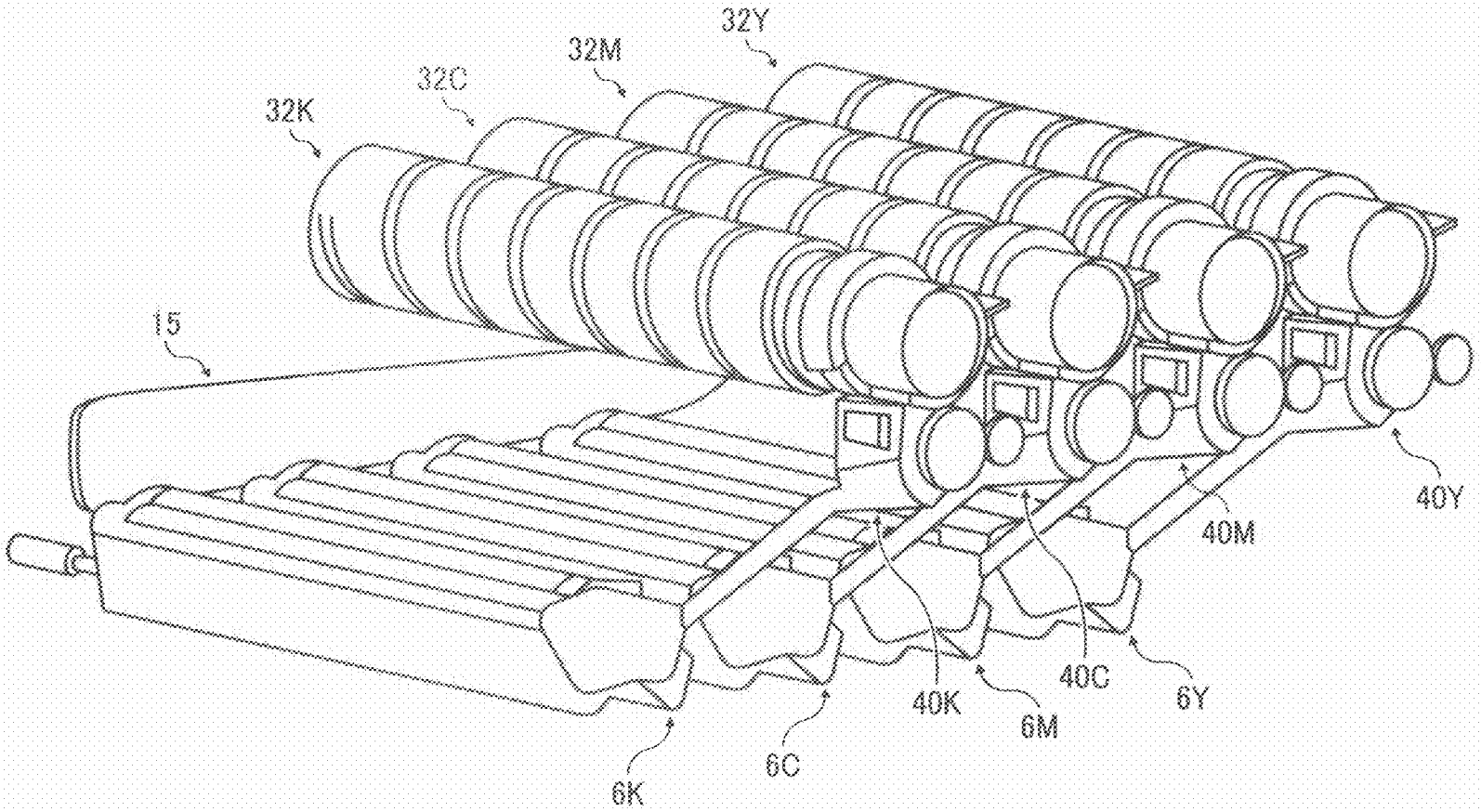
FIG. 4 is a perspective view of toner bottles, an intermediate transfer unit, and a toner replenishing device.

FIG. 4 is a perspective view of the toner bottles 32Y, M, C, K, toner replenishing devices 40Y, M, C, K, the intermediate transfer unit 15, and the process cartridges 6Y, M, C, K.

The toner replenishing devices 40Y, M, C, K are provided on the main body of the printer 100 on the rear side of the intermediate transfer unit 15 in FIG. 1. Therefore, toner conveying units are not required to be provided on the process cartridges 6Y, M, C, K or the toner bottles 32Y, M, C, K. This enables the process cartridges 6Y, M, C, K or the toner bottles Y, M, C, K to be reduced in size in comparison with the conventional ones. Furthermore, in the conventional technique, since the process cartridges and the toner bottles are arranged to be close contact with each other, there is restriction in design. However, the process cartridges and the toner bottles can be arranged to be separated from each other in the printer 100. Therefore, the degree of freedom in design is improved, and thereby the printer 100 can be reduced in size.

Furthermore, in the printer 100, discharge ports of the toner bottles 32Y, M, C, K, the toner replenishing devices 40Y, M, C, K, toner replenishing ports of the developer containers 54Y, M, C, K in the developing units 5Y, M, C, K are arranged on one end side of the intermediate transfer unit 15. Therefore, the toner conveying paths of the toner replenishing devices 40Y, M, C, K can be made the shortest. This makes it possible to reduce the printer 100 in size and to prevent clogging during the toner conveyance from occurring.

Hereinafter, the toner replenishing device 40M for conveying the M toner is described since configurations of the toner replenishing devices 40Y, M, C, K are the same.

Figure 5:
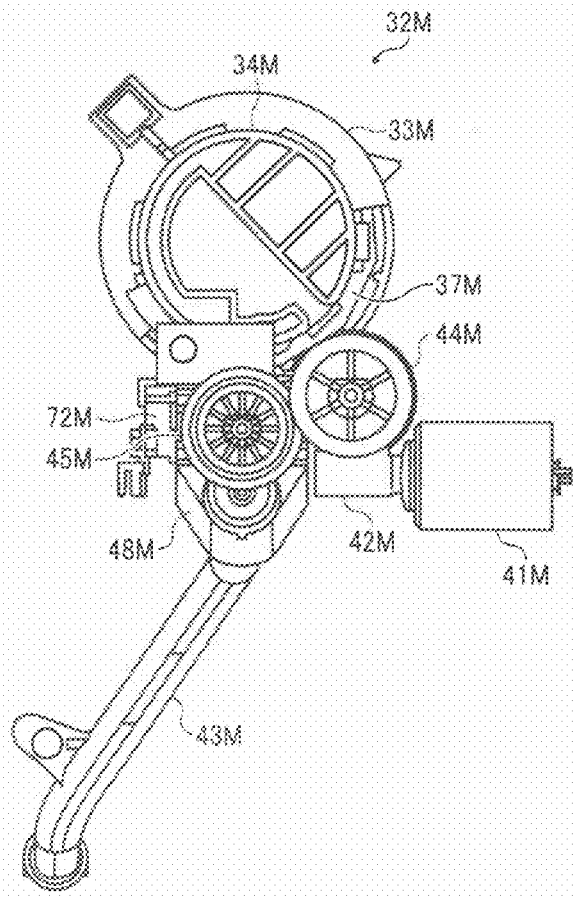
FIG. 5 is a front view of the toner replenishing device and the toner bottle.
Figure 6:
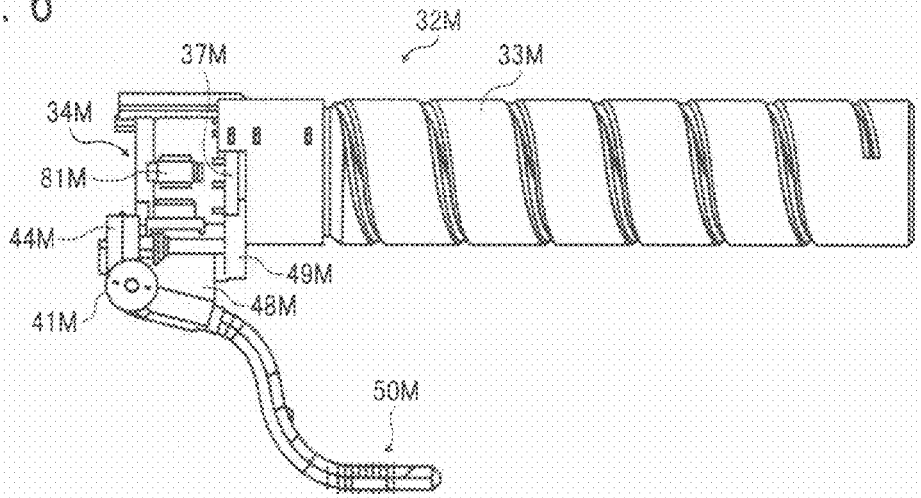
FIG. 6 is a right side view of FIG. 5.
Figure 7:
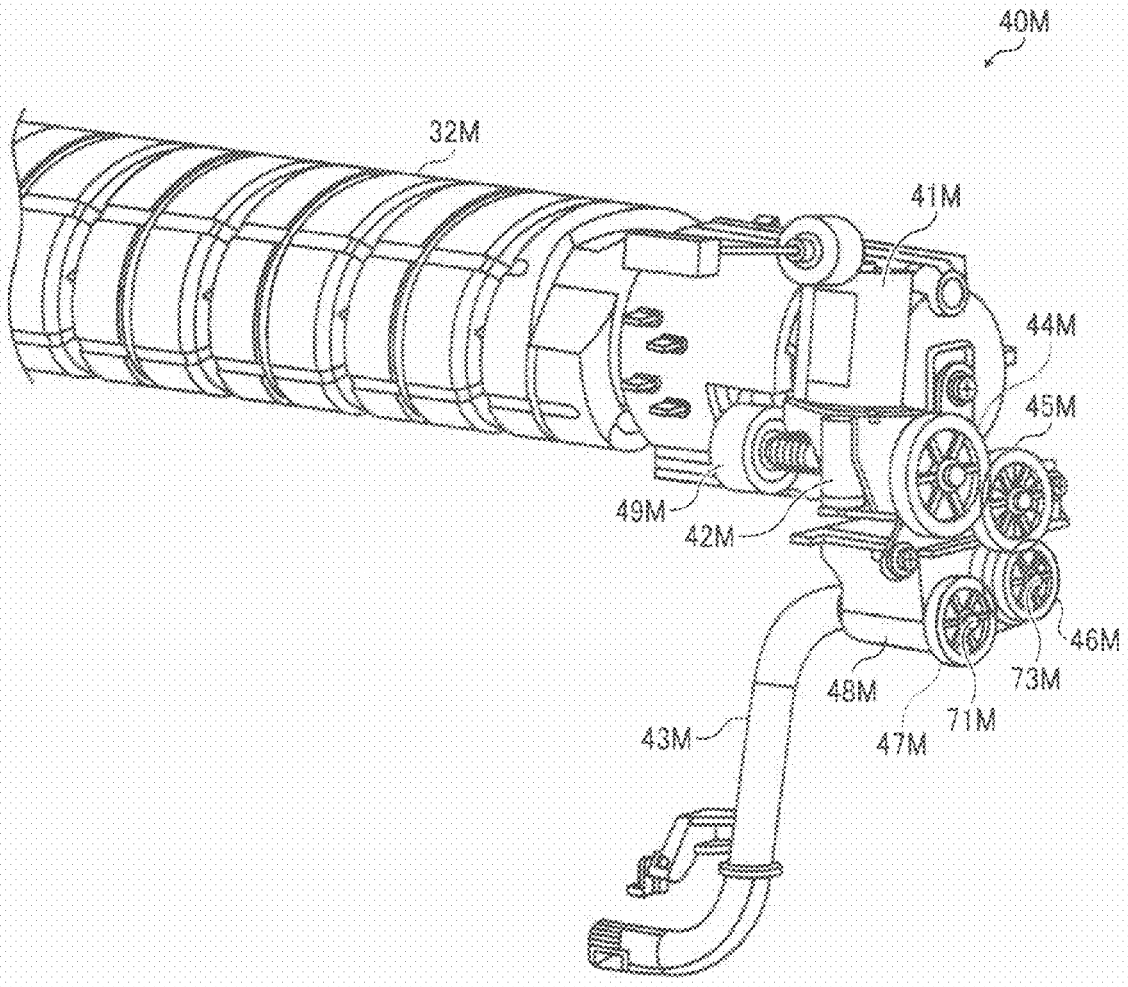
FIG. 7 is a perspective view of FIG. 5 when seen from the upper left side.
Figure 8:
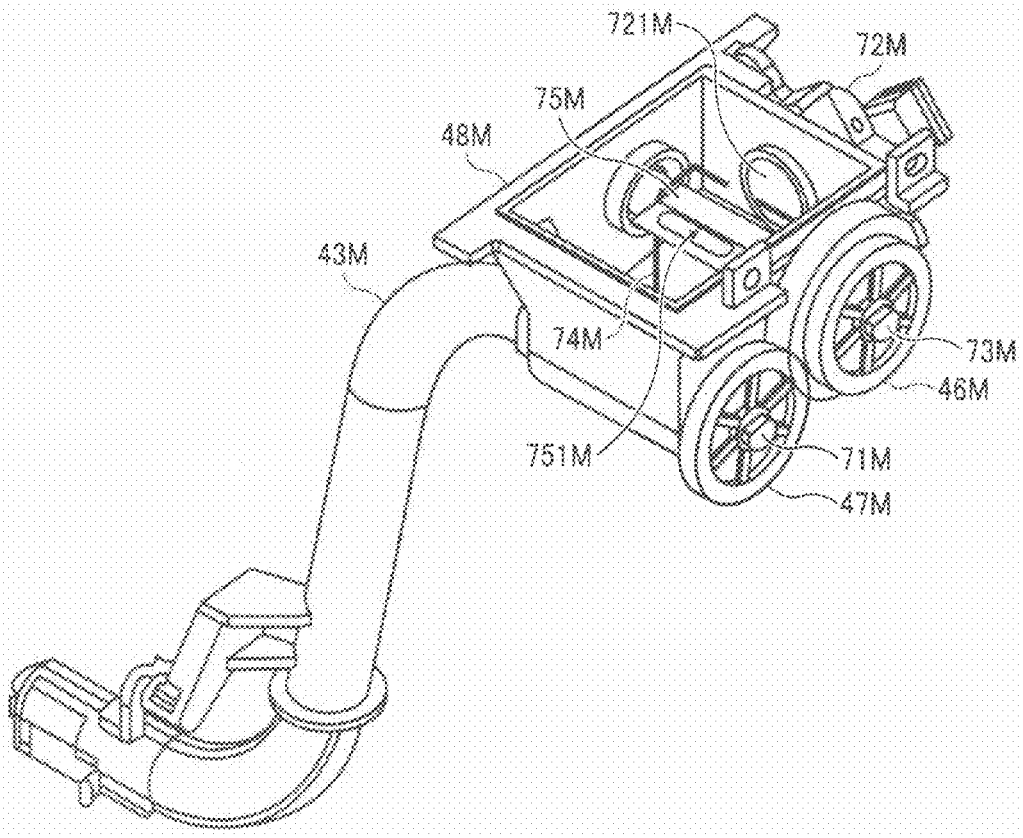
FIG. 8 is a schematic perspective view of an inner portion of a sub hopper when seen from the upper left direction.
Figure 9:
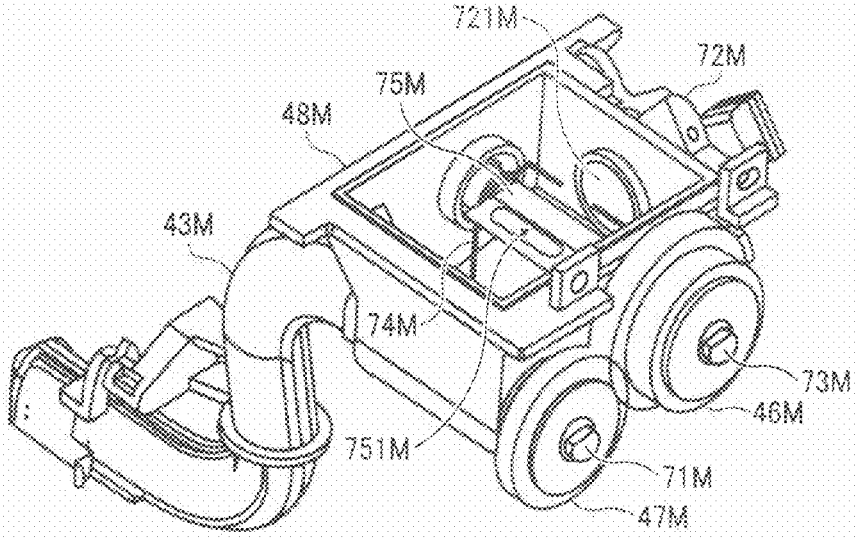
FIG. 9 is a schematic perspective view of the inner portion of the sub hopper when seen from the upper left direction at an angle deviated from that in FIG. 8.
Figure 10:
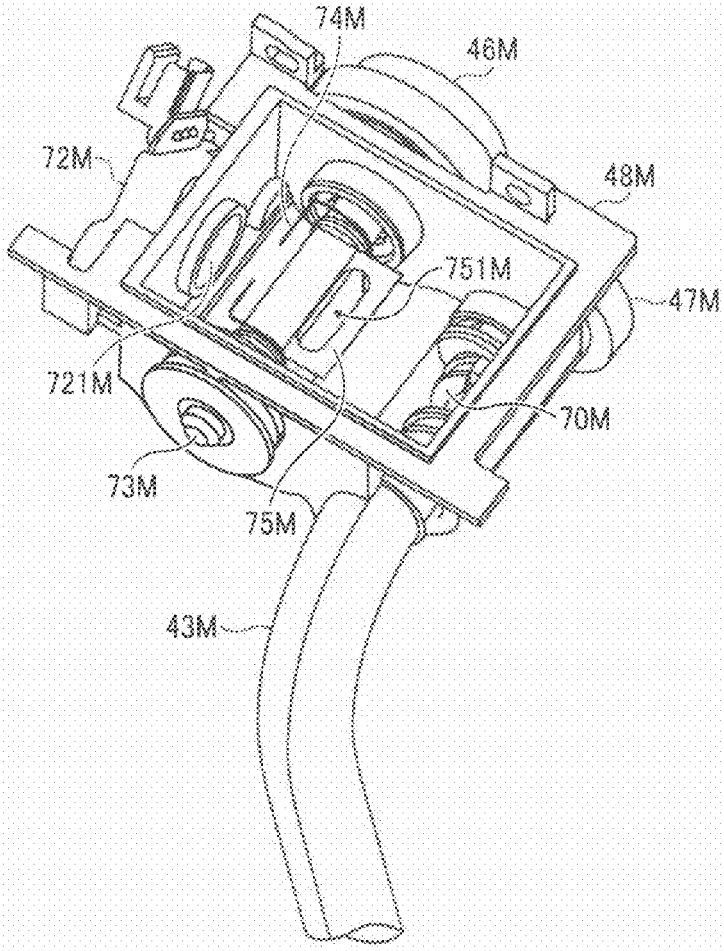
FIG. 10 is a schematic perspective view of the inner portion of the sub hopper when seen from the upper left direction on the rear side.
Figure 11:
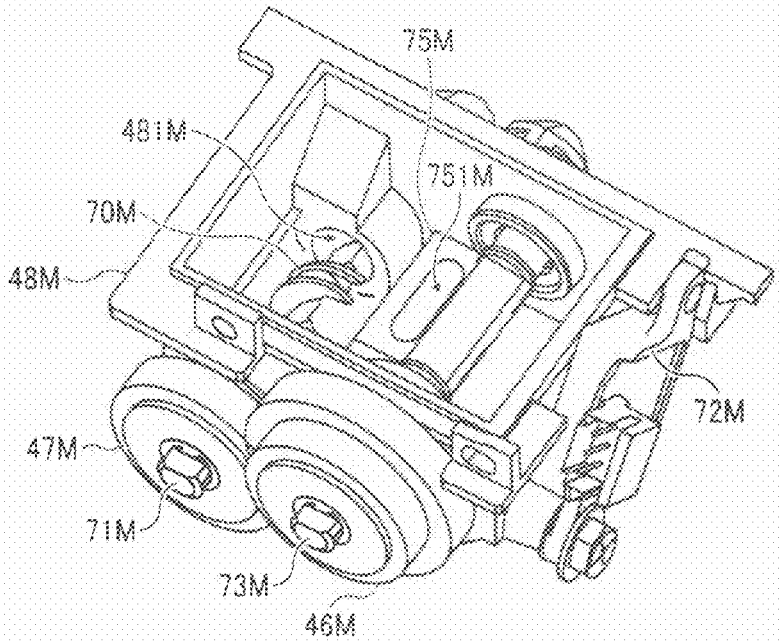
FIG. 11 is a schematic perspective view of the inner portion of the sub hopper when seen from the upper right direction.

FIG. 5 is a front view of the toner replenishing device 40M and the toner bottle 32M. In FIG. 5, the toner bottle base 31 is not illustrated. FIG. 6 is a right side view of FIG. 5. FIG. 7 is a perspective view of FIG. 5 when seen from the upper left side. It is to be noted that the toner replenishing devices 40Y, C, K, and the toner bottles 32Y, C, K are also arranged in the same manner as the toner replenishing device 40M and the toner bottle 32M although not illustrated.

The toner replenishing device 40M is mainly configured by a driving motor 41M as a toner replenishing operation driving source, a worm gear 42M, a driving transmission gear 44M, a sub hopper 48M as a toner container, and a toner conveying pipe 43M as a toner feeding path. The toner conveying pipe 43M includes a toner replenishing conveying member. The driving force from the driving motor 41M is transmitted to the driving transmission gear 44M through the worm gear 42M that rotates about the same axis as that of the driving motor 41M.

A bottle driving transmission gear 49M of which axis is the same as that of the driving transmission gear 44M is provided. The bottle driving transmission gear 49M engages with the bottle rotation gear 37M of the toner bottle 32M. If the driving motor 41M is rotated, the bottle main body 33M that rotates integrally with the bottle rotation gear 37M of the toner bottle 32M is rotated.

Furthermore, a replenishing driving transmission gear 45M is arranged on the side of the sub hopper 48M to engage with the driving transmission gear 44M. The replenishing driving transmission gear 45M is provided on a rotating shaft of a toner agitation member, which will be described in detail later, and an agitation side bevel gear 46M is provided on the rotating shaft. A toner conveying coil made of resin, which will be described in detail later, is made inner contact with an inner portion of the toner conveying pipe 43M. A conveyance side bevel gear 47M is provided on the rotating shaft of the toner conveying coil.

Furthermore, if the density detection sensor 56M of the developing unit 5M as illustrated in FIG. 2 detects shortage of toner density in the developer container 54M, the driving motor 41M rotates with a replenishment signal from a control unit 57M. A spiral-form developer guiding groove 38M is formed on an inner surface of an inner wall of the bottle main body 33M. Therefore, toner in the bottle main body 33M is conveyed to the side of the resin case 34M at a tip from the rear side in the bottle main body 33M by the rotation. Furthermore, toner in the bottle main body 33M drops into the sub hopper 48M of the toner replenishing device 40M from a discharge port (not illustrated) of the resin case 34M. The sub hopper 48M is communicated with the toner conveying pipe 43M at a lower portion thereof. If the driving motor 41M is rotated, the bottle main body 33M is also rotated. At the same time, the toner agitation member in the sub hopper 48M and the toner conveying coil in the toner conveying pipe 43M are simultaneously rotated. Toner reached to a lower portion of the sub hopper 48M is conveyed in the toner conveying pipe 43M with the rotation of the toner conveying coil. Then, the toner is replenished to the toner replenishing port (not illustrated) of the developer container 54M of the developing unit 5M. In this manner, the toner density in the developing unit 5M is adjusted.

It is to be noted that the conveying coil in the toner conveying pipe 43M is made of metal, the following problem occurs. When an outer circumferential surface of the conveying coil made of metal is made in friction against an inner circumferential surface of the toner conveying pipe, an aggregation nuclei of toner is generated in some cases. Then, the aggregation nuclei of the toner causes a defect image such as white out in some cases. A feeding coil made of resin is used in the toner replenishing device 40M. Therefore, even when the outer circumferential surface of the feeding coil is made in friction against the inner circumferential surface of the toner conveying pipe, the friction is small. Accordingly, such aggregation nuclei of toner is not generated to prevent a defect image such as white out. In the toner replenishing device 40M according to the embodiment, a conveying rotating shaft 71 is adhered to an inner side of a toner conveying coil 70 (see FIG. 12) in the sub hopper 48M.

Figure 12:
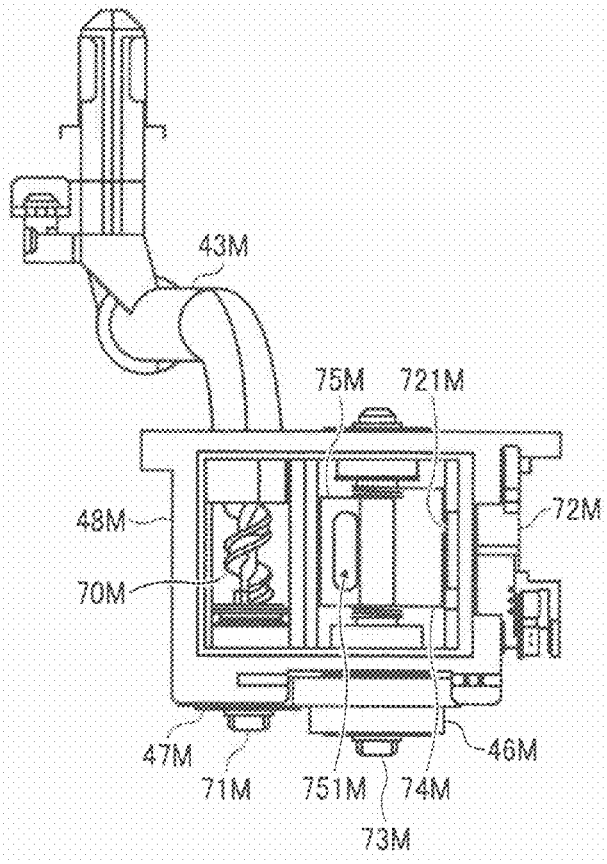
FIG. 12 is a schematic top view of the inner portion of the sub hopper when seen from the above.

Next, the sub hopper 48M is described in detail. FIG. 8 through FIG. 11 are schematic perspective views of an inner portion of the sub hopper 48M when seen from the oblique upper side. FIG. 12 is a schematic top view of the inner portion of the sub hopper 48M when seen from the above. As illustrated in FIG. 8 through FIG. 11, a toner detection sensor 72M is provided on a side face of the sub hopper 48M. The toner detection sensor 72M detects whether toner remains at a height of a sensor detection surface 721M provided in the sub hopper 48M. By detecting that toner is not supplied from the toner bottle 32M and toner does not remain on the sensor detection surface 721M, near empty can be detected. The near empty indicates a state where toner in the toner bottle 32M does not remain but toner in the sub hopper 48M remains. It is to be noted that as the toner detection sensor 72M, a piezoelectric vibration type toner level sensor manufactured by TDK Corporation is used.

If it is detected whether toner remains in the sub hopper 48M by using the above toner detection sensor 72M, the toner detection sensor 72M makes erroneous detection that toner does not remain although toner remains in the sub hopper 48M in some cases. The inventors enthusiastically studied about a reason for the erroneous detection. As a result of the enthusiastic study, they found that the erroneous detection was made immediately after the detection surface of the toner detection sensor was cleaned. Therefore, the inventors enthusiastically studied for details further. Then, they found that the erroneous detection was made because the sub hopper 48M of which capacity was smaller than the conventional one was used to reduce the device in size.

Figure 26A:
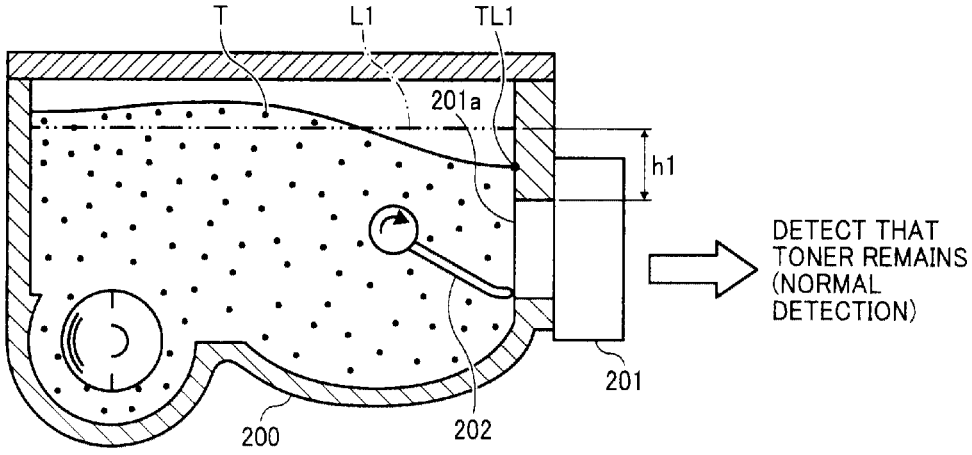
FIG. 26A is a schematic cross-sectional view of the inner portion of the sub hopper viewed through from the front side illustrating a state where a sensor detection surface in a conventional sub hopper having a large capacity is cleaned.
Figure 26B:
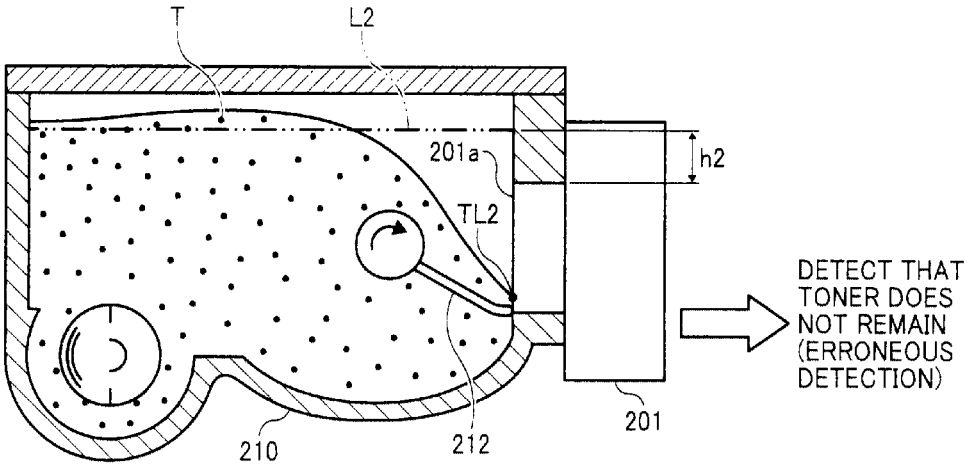
FIG. 26B is a schematic cross-sectional view of the inner portion of the sub hopper viewed through from the front side illustrating a state where a sensor detection surface in a sub hopper having a small capacity is cleaned.

FIGS. 26A and 26B are views for explaining the reason of the above erroneous detection. FIG. 26A is a descriptive view for explaining a configuration in which a tip of the toner agitation member is abutted against the detection surface of the toner detection sensor to clean the detection surface in a sub hopper having a conventional capacity. FIG. 26B is a descriptive view for explaining a configuration in which a tip of the toner agitation member is abutted against the detection surface of the toner detection sensor to clean the detection surface in a sub hopper having a small capacity.

In FIG. 26A, when a sub hopper 200 is filled with toner T, a distance h1 from the top of a detection surface 201*a* of a toner detection sensor 201 to an average toner level L1 is sufficiently ensured. Even when a toner level TL1 on the side of the detection surface lowers immediately after a toner agitation member 202 has rotated to clean the detection surface 201*a*, the toner T covers the detection surface 201*a*. Therefore, the toner detection sensor 201 normally detects that toner remains. Furthermore, even when a space on which there is no toner T is generated and there is no toner T that makes contact with the detection surface 201*a* temporarily by cleaning the detection surface 201*a* by the toner agitation member 202, the toner T around the space flows into the space, and thereby the space is filled with the toner T soon. On the other hand, in the case of FIG. 26B, since the size of the toner detection sensor 201 is the same as that in FIG. 26A, a distance h2 between an upper portion of the detection surface 201*a* and an average toner level L2 is smaller than the distance h1 because a sub hopper 210 is reduced in size. In addition, since the capacity of the sub hopper 210 is small, a toner level TL2 on the side of the detection surface excessively lowers immediately after a toner agitation member 212 has cleaned the detection surface 201*a*. The toner level TL2 on the side of the detection surface gradually rises with the rotation of the toner agitation member 212. However, if the toner detection sensor 201 makes detection before the toner level TL2 rises, the toner detection sensor 201 makes erroneous detection that toner does not remain in the sub hopper 210 although toner sufficiently remains therein.

To prevent the erroneous detection from occurring, in the toner replenishing device 40M according to the embodiment, an agitator 74M as a detection surface cleaning member and a paddle 75M as a toner collecting member corresponding to a toner collecting unit are provided on the sub hopper 48M. The agitator 74M rotates in the sub hopper 48 to clean the sensor detection surface 721M of the toner detection sensor 72M. The paddle 75M rotates in the sub hopper 48 to fill a space generated in the vicinity of the sensor detection surface 721M after cleaned by the agitator 74M.

Figure 13:
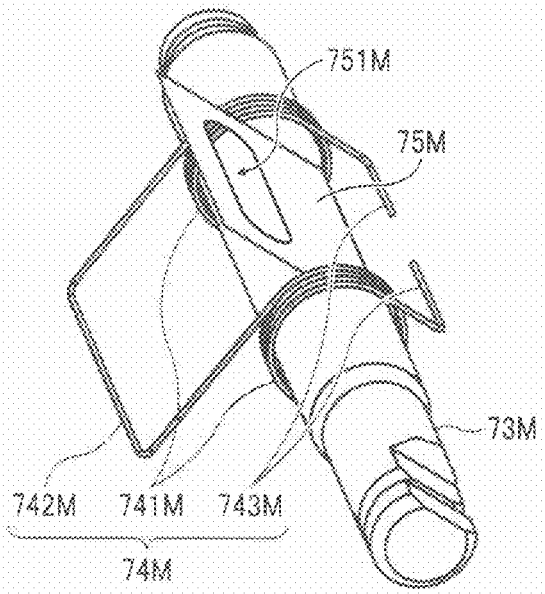
FIG. 13 is a perspective view of an agitation rotating shaft on which an agitator and a paddle are arranged.

FIG. 13 is a perspective view illustrating a state where the agitator 74M and the paddle 75M are attached to an agitation rotating shaft 73M as a cleaning member driving shaft provided in the sub hopper 48M.

In FIG. 13, the agitator 74M is provided on the agitation rotating shaft 73M as a rotating shaft of the agitation side bevel gear 46M. The agitation side bevel gear 46M is rotationally driven by the replenishing driving transmission gear 45M to which driving force is transmitted from the driving transmission gear 44M. The agitator 74M is formed by an elastic wire that cleans the sensor detection surface 721M while rotating with the rotation of the agitation rotating shaft 73M. The agitator 74M is configured by a double torsion spring formed by coupling two torsion coil springs 741M to each other and can receive a torsion moment about an axial line of two torsion coil springs 741M. A substantially U-shaped arm 742M is formed on a center portion of two coupled torsion coil springs 741M. Hooks 743M that are bent to an inner side are formed on both ends of the torsion coil springs 741M. A tip of the arm 742M abuts against the sensor detection surface 721M to clean the sensor detection surface 721M. Furthermore, the hooks 743M at both ends are formed to engage with the paddle 75M. A space between tips is set to be smaller than the width of the paddle 75M. The agitator 74M is supported to be rotatable by inserting the agitation rotating shaft 73M into two torsion coil springs 741M. Since the paddle 75M is fixed to the agitation rotating shaft 73M, if the agitation rotating shaft 73M rotates, the paddle 75M engages with and gets caught by the hooks 743M at both ends of the agitator 74M, so that the rotating force of the agitation rotating shaft 73M is applied to the agitator 74M. If a load is applied onto the arm 742M of the agitator 74M in a state where the paddle 75M engages with and gets caught by the hooks 743M at both ends of the agitator 74M, the arm 742M receives the load to wind up the torsion coil springs 741M. Therefore, coil diameters of the torsion coil springs 741M are reduced, and the arm 742M is elastically deformed about the axial line of the torsion coil springs 741M to the side of the hooks 743M.

It is to be noted that as a material of the agitator 74M, elastic wires such as a hard steel wire (SW-C), a piano wire (SWP-A, SWP-B), and a spring stainless steel line (SUS304-WPB) are preferably used. However, the material is not limited to the elastic wires as long as the material has flexibility and may be resin such as PET. Furthermore, a configuration in which a plurality of materials are combined may be employed. For example, a configuration in which a portion of the agitator 74M, which cleans the sensor detection surface 721M, is made of a rigid material and an attachment portion thereof to the agitation rotating shaft 73M is made of an elastic material may be employed. Any configurations may be employed as long as the material enables the agitator 74M to rotate while friction-sliding on the sensor detection surface 721M with an engagement amount.

Furthermore, it is sufficient that the arm 742M is elastically deformed about the axial line of the torsion coil springs 741M to the side of the hooks 743M. Therefore, the agitator 74M may not be supported by the agitation rotating shaft 73M in a rotationally movable manner and may be fixed to the agitation rotating shaft 73M.

The agitator 74M having the following shape is used. A length from the agitation rotating shaft 73M to a tip of the agitator 74M is the same as a distance from the agitation rotating shaft 73M to the sensor detection surface 721M or longer than the distance by about 1 mm. The width of the agitator 74M in an axial line direction of the agitation rotating shaft 73M is larger than that of the sensor detection surface 721M. In the toner replenishing device 40M, since the width of the sensor detection surface 721M is about 9 mm, the agitator 74M having a width of 9 to 20 mm is used although depending on the size of the inner portion of the sub hopper 48M. In particular, the agitator 74M having a width of 17 mm is used in the device.

Since the length of the agitator 74M is longer than the distance from the agitation rotating shaft 73M to the sensor detection surface 721M, a tip of the agitator 74M friction-slides on the sensor detection surface 721M with an engagement amount. Therefore, the agitator 74M scraps off the toner adhered to the sensor detection surface 721M. This makes it possible to prevent erroneous detection due to toner adhered to the sensor detection surface 721M, that is, erroneous detection in which a toner end cannot be detected although toner does not remain from occurring.

A paddle opening 751M as an opening is provided on the above paddle 75M. With the paddle opening 751M, agitation of toner is suppressed to the minimum and a space generated in the vicinity of the sensor detection surface 721M by the agitator 74M can be filled with toner.

A period of time for which a space is formed in the vicinity of the sensor detection surface 721M is assumed to be t1, and a period of time in which the space in the vicinity of the sensor detection surface 721M is filled with toner by the paddle 75M is assumed to be t2. In this case, it is desirable that a relationship of $t1<t2$ is satisfied. With this, erroneous detection due to shortage of the toner in the vicinity of the sensor detection surface 721M can be prevented from occurring.

Figure 16:
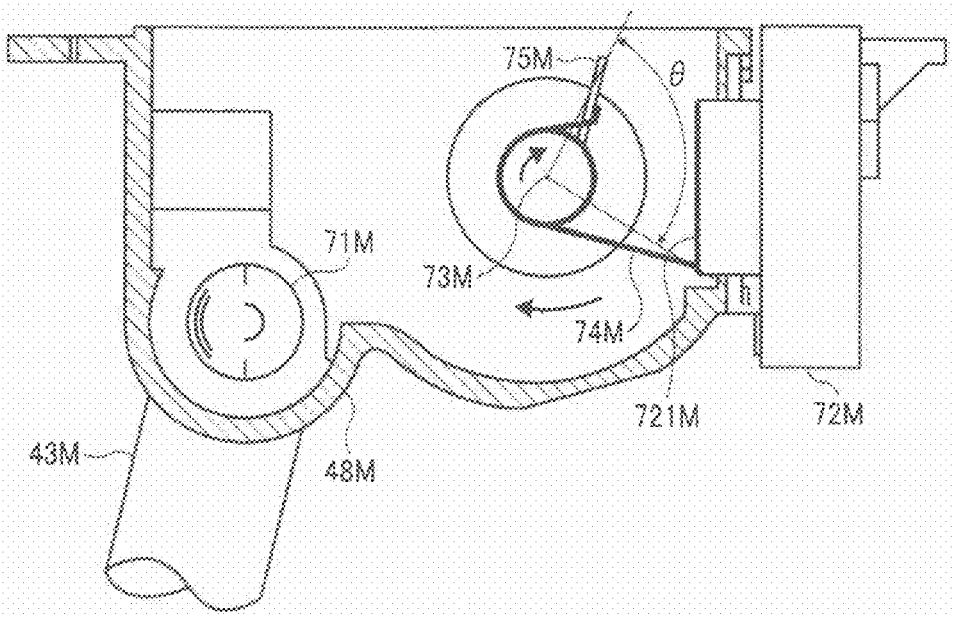
FIG. 16 is another schematic cross-sectional view of the inner portion of the sub hopper when seen through from the front side for explaining an operation of the agitator.
Figure 17:
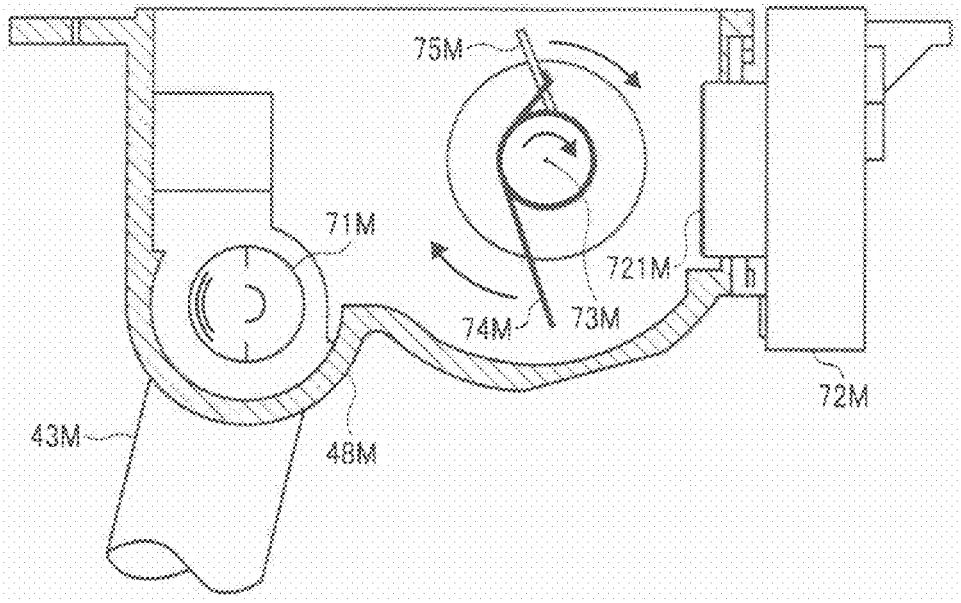
FIG. 17 is another schematic cross-sectional view of the inner portion of the sub hopper when seen through from the front side for explaining an operation of the agitator.

As illustrated in FIG. 16, an angle formed by the tip of the agitator 74M and a tip of the paddle 75M on a virtual plane perpendicular to the agitation rotating shaft 73M is referred herein as to an agitator-to-paddle angle θ. At this time, a rotational axis core of the agitation rotating shaft 73 is set as a center. In this case, a relationship of $0°<$agitator-to-paddle angle $\theta\leq 180°$ is set to be satisfied immediately after the agitator 74M has passed through on the sensor detection surface 721M while friction-sliding thereon (immediately after the cleaning). To be more desirable, a relationship of $0°<$agitator-to-paddle angle $\theta<90°$ is satisfied. With this, after the agitator 74M has cleaned the sensor detection surface 721M, the paddle 75M passes through the vicinity of the sensor detection surface 721M until the agitation rotating shaft 73M at least half rotates. Therefore, a space generated when the agitator 74M cleans the sensor detection surface 721M can be filled with toner immediately. To set the agitator-to-paddle angle θ within the above range, an angle formed by the arm 742M and the hooks 743M of the agitator 74M in a no-load state about the axial line of the torsion coil springs 741M and a spring constant are appropriately set. With this configuration, the agitator 74M makes contact with the sensor detection surface 721M first, and then, the paddle 75M passes through the vicinity of the sensor detection surface 721M in the rotational direction of the agitation rotating shaft 73M. Therefore, a space generated in the vicinity of the sensor detection surface 721M when the agitator 74M passes therethrough can be filled with toner by the paddle 75M soon. Furthermore, as the agitator-to-paddle angle θ is closer to zero, t2 is much larger than t1. That is, a period of time for which the space is formed is much shorter to prevent erroneous detection by the toner detection sensor 72M from occurring. On the other hand, the agitator-to-paddle angle θ is larger than 180°, a relationship between t1 and t2 satisfies $t1>t2$. Note that t1 indicates a period of time for which a space is formed in the vicinity of the sensor detection surface 721M and t2 indicates a period of time for which the space in the vicinity of the sensor detection surface 721M is filled with toner by the paddle 75M. Therefore, the period of time for which the space is formed is longer than the period of time for which the space is filled with toner to cause a risk that erroneous detection is made by the toner detection sensor 72M.

Furthermore, the agitator-to-paddle angel θ may be set such that a period of time taken since the agitator 74M has passed through the sensor detection surface 721M until the paddle 75M passes therethrough is a period of time to the extent that the erroneous detection is not made by the sensor.

In the embodiment, as described above with reference to FIG. 13, the paddle 75M is fixed to the agitation rotating shaft 73M. Furthermore, an elastic wire is used for the agitator 74M and both ends of the agitator 74M are formed by the torsion coil springs 741M to have spring property. The agitator 74M is arranged by inserting the agitation rotating shaft 73M into the torsion coil springs 741M. In addition, by providing the hooks 743M for getting caught at both ends of the agitator 74M, the hooks 743M at both ends of the agitator 74M engage with the paddle 75M when the paddle 75M rotates. With the engagement, the agitator 74M rotationally operates together with the paddle 75M and the agitation rotating shaft 73M.

FIG. 14 through FIG. 19 are views for explaining an outline of a series of operations of the agitator 74M and the paddle 75M according to the embodiment. By repeating operations illustrated in FIG. 14 through FIG. 19, the agitator 74M can clean the sensor detection surface 721M and a space generated in the vicinity of the sensor detection surface 721M can be filled with toner by the paddle 75M.

At first, if the agitation rotating shaft 73M rotates, the paddle 75M also rotates. Furthermore, the agitator 74M is dependent-rotated by being pressed by and following the paddle 75M.

Figure 14:
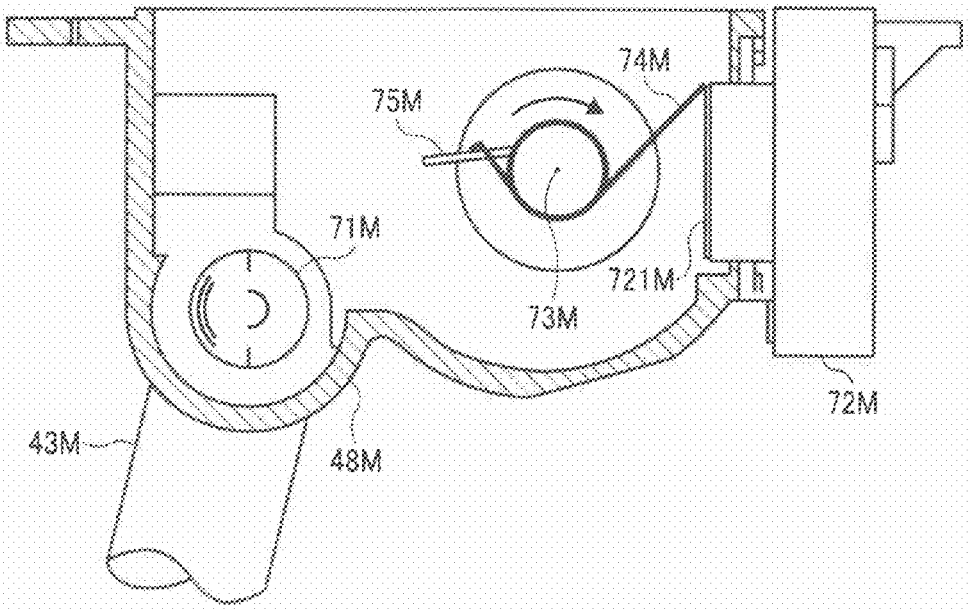
FIG. 14 is a schematic cross-sectional view of the inner portion of the sub hopper when seen through from the front side for explaining an operation of the agitator.
Figure 15:
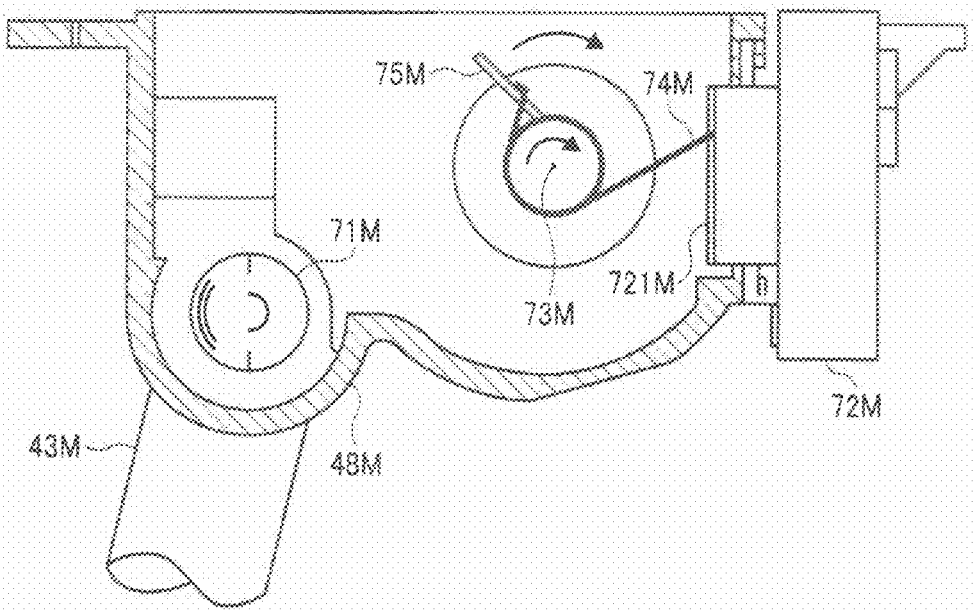
FIG. 15 is another schematic cross-sectional view of the inner portion of the sub hopper when seen through from the front side for explaining an operation of the agitator.

Then, as illustrated in FIG. 14, the agitator 74M abuts against the sensor detection surface 721M. Since the agitator 74M has a spring property, the paddle 75M continues to rotate but the agitator 74M stays on the sensor detection surface 721M as it is (in states illustrated in FIG. 14 through FIG. 16). At this time, the agitator-to-paddle angle θ becomes equal to or smaller than 180°. Furthermore, the agitator-to-paddle angle θ is gradually smaller and spring force gradually increases. When the spring force larger than static friction force of the agitator 74M is obtained, the agitator 74M passes through on and cleans the sensor detection surface 721M (see FIG. 15 through FIG. 17).

Figure 18:
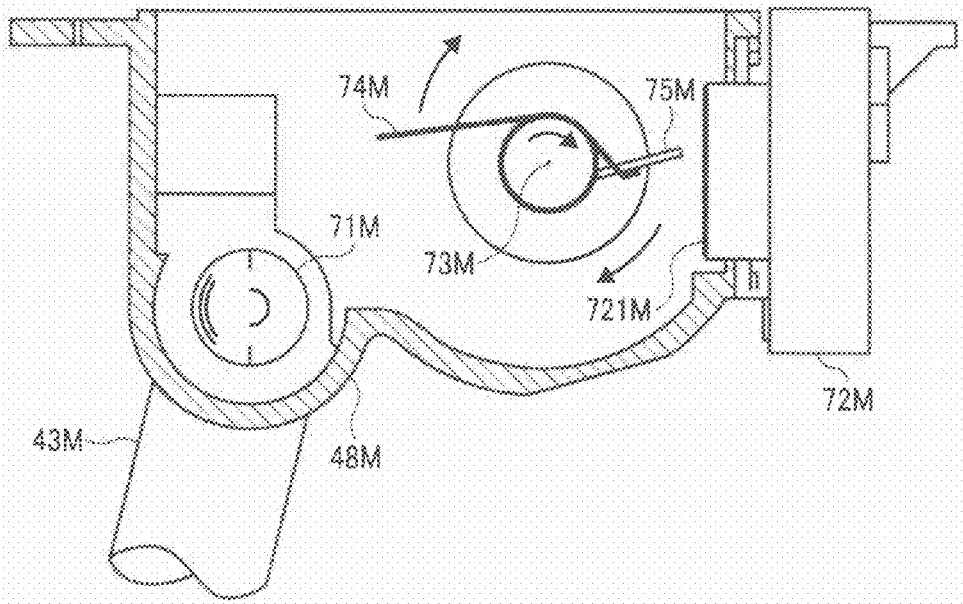
FIG. 18 is another schematic cross-sectional view of the inner portion of the sub hopper when seen through from the front side for explaining an operation of the agitator.
Figure 19:
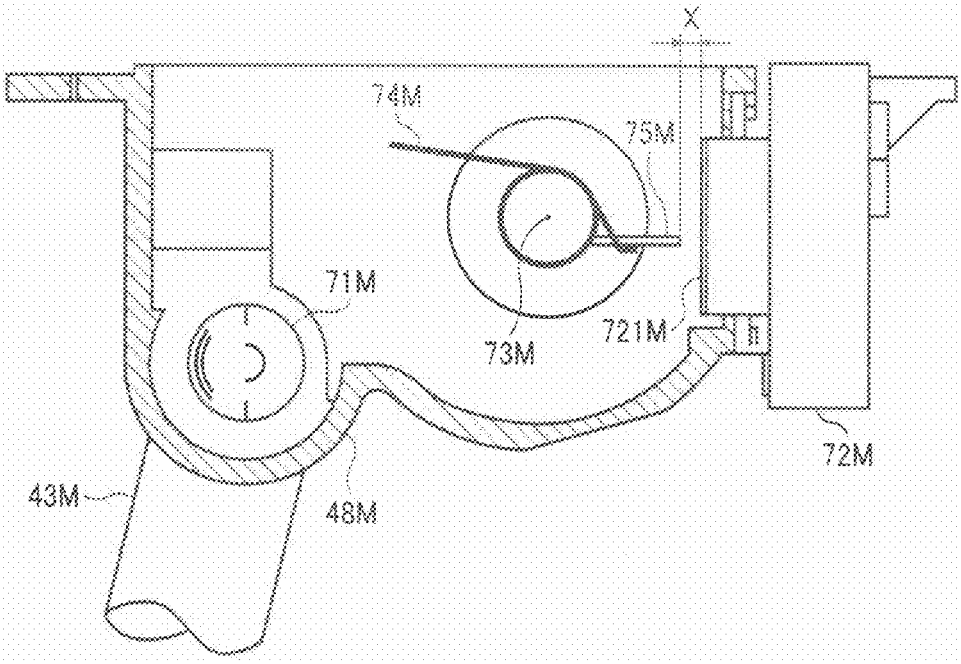
FIG. 19 is a schematic cross-sectional view of the inner portion of the sub hopper when seen through from the front side for explaining a space between the paddle and a sensor detection surface.

As illustrated in FIG. 18, immediately after the agitator 74M has passed through on and cleaned the sensor detection surface 721M, the paddle 75M passes through the vicinity of the sensor detection surface 721M and collects toner to the side of the sensor detection surface 721M. Accordingly, the space generated in the vicinity of the sensor detection surface 721M when the agitator 74M has passed therethrough is filled with toner by the paddle 75M.

As a result of an enthusiastic experiment by the inventors, the inventors found the following fact. A distance between the sensor detection surface 721M and a tip of the paddle 75M when the paddle 75M comes closest to the sensor detection surface 721M is referred herein as to a paddle-to-sensor distance X. The inventors found that it was the most appropriate that a relationship of 0 mm<paddle-to-sensor distance X≤2 mm was satisfied. If the paddle-to-sensor distance X is 0 mm, the paddle 75M slides on the sensor detection surface 721M. Therefore, a space is further formed on the sensor detection surface 721M. On the other hand, if the paddle-to-sensor distance X is larger than 2 mm, a space on the sensor detection surface 721M cannot be filled with toner preferably to cause erroneous detection.

The paddle 75M is a plate-like member formed by a Mylar (registered trademark), for example, and the agitation rotating shaft 73M rotates at high speed. Therefore, toner in the sub hopper 48M is excessively agitated by the paddle 75M. As a result, air excessively mixes into the toner, and an amount of toner per unit volume becomes small partially. Accordingly, the toner detection sensor 72M makes erroneous detection in some cases. To eliminate the problem, the paddle opening 751M is provided on a part of the paddle 75M according to the embodiment. Therefore, toner can be collected onto the sensor detection surface 721M while suppressing the agitation of the toner to the minimum. Therefore, the toner detection sensor 72M can accurately detect whether toner remains while preventing toner from being excessively agitated.

The paddle 75M having a width larger than that of the sensor detection surface 721M is used, so that a space generated in the vicinity of the sensor detection surface 721M can be accurately filled with toner. In the toner replenishing device 40M, the paddle 75M having a width of 9 to 20 mm is used although depending on the size of the inner portion of the sub hopper 48M. In particular, the paddle 75M having a width of 15 mm is used in the device.

Figure 20:
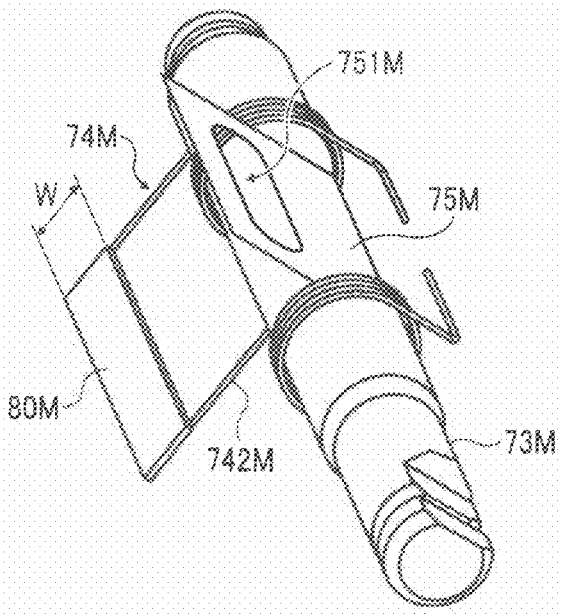
FIG. 20 is a perspective view of the agitation rotating shaft on which the agitator and the paddle are arranged and illustrating a plate-like member provided on a tip of the agitator.
Figure 21:
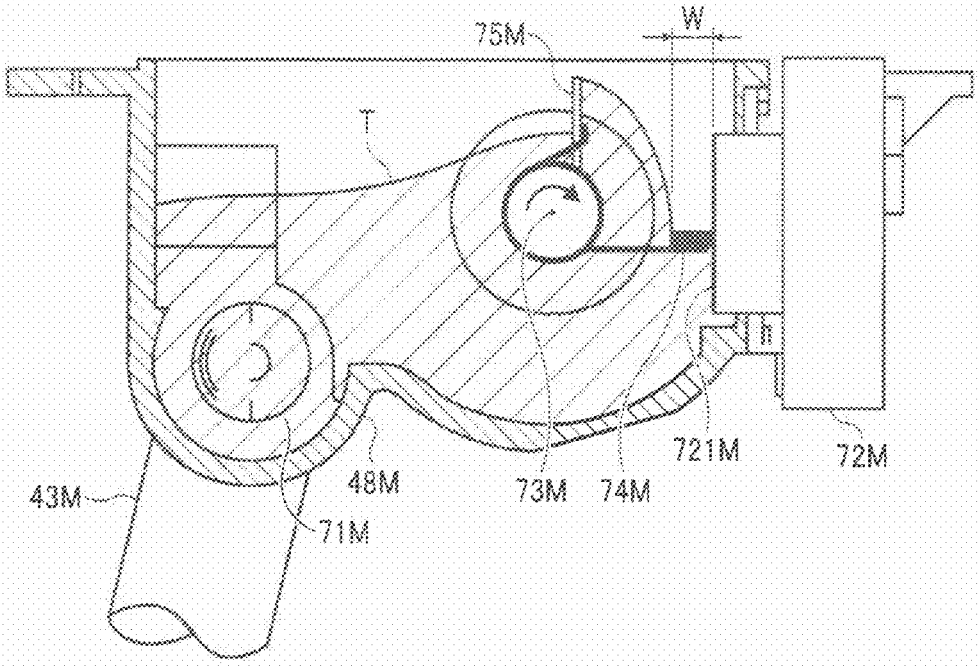
FIG. 21 is a schematic cross-sectional view of the inner portion of the sub hopper when seen through from the front side for explaining a space generated by the agitator illustrated in FIG. 20.

Furthermore, the inventors studied about an appropriate area cleaned by the agitator 74M when the agitator 74M cleans the sensor detection surface 721M while friction-sliding on the sensor detection surface 721M. To be more specific, the inventors studied about an appropriate distance (mm) from the sensor detection surface 721M in the direction perpendicular to the sensor detection surface to be set as a cleaning area. FIG. 20 is a perspective view illustrating a state where the agitator 74M and the paddle 75M are attached to the agitation rotating shaft 73M and illustrating a state where a plate-like member 80M is provided on the agitator 74M. FIG. 21 is a schematic cross-sectional view of an inner portion of the sub hopper 48M including the agitation rotating shaft 73M as illustrated in FIG. 20 when seen through from the front side. In FIG. 20, the plate-like member 80M having a width W in the radius direction (short-side direction) is attached to the tip of the arm 742M of the agitator 74M. If the sensor detection surface 721M is cleaned by using the agitator 74M, a space having a width W is formed between the sensor detection surface 721M and toner. The space is filled by the paddle 75M. However, as a result of enthusiastic study about the width W of the plate-like member 80M in the radius direction by the inventors, they found that it was the most appropriate to set the width W to be equal to or smaller than 1 mm. That is, it was found that the cleaning area by the agitator 74M is preferably set to within 1 mm from the sensor detection surface 721M in the direction perpendicular to the sensor detection surface 721M. Therefore, it is desirable that the agitator 74M is formed by an elastic wire having a wire diameter of equal to or smaller than ϕ1 mm. If the agitator 74M formed by an elastic wire passes through on the sensor detection surface 721M, a narrow space like a space formed by cutting a soft powder body (toner) with a knife is formed. Then, the paddle 75M puts toner into the space to fill the space with toner immediately. Furthermore, the agitator 74M can scrap off toner adhered to the sensor detection surface 721M only and scrap off less toner in the vicinity of the sensor detection surface 721M. With this, excessive agitation of toner is suppressed and the space in the vicinity of the sensor detection surface 721M, which has been generated when the agitator 74M has cleaned the sensor detection surface 721M, can be filled with toner around the space immediately. Accordingly, erroneous detection that a toner end is detected although toner still remains can be prevented from occurring.

Figure 22:
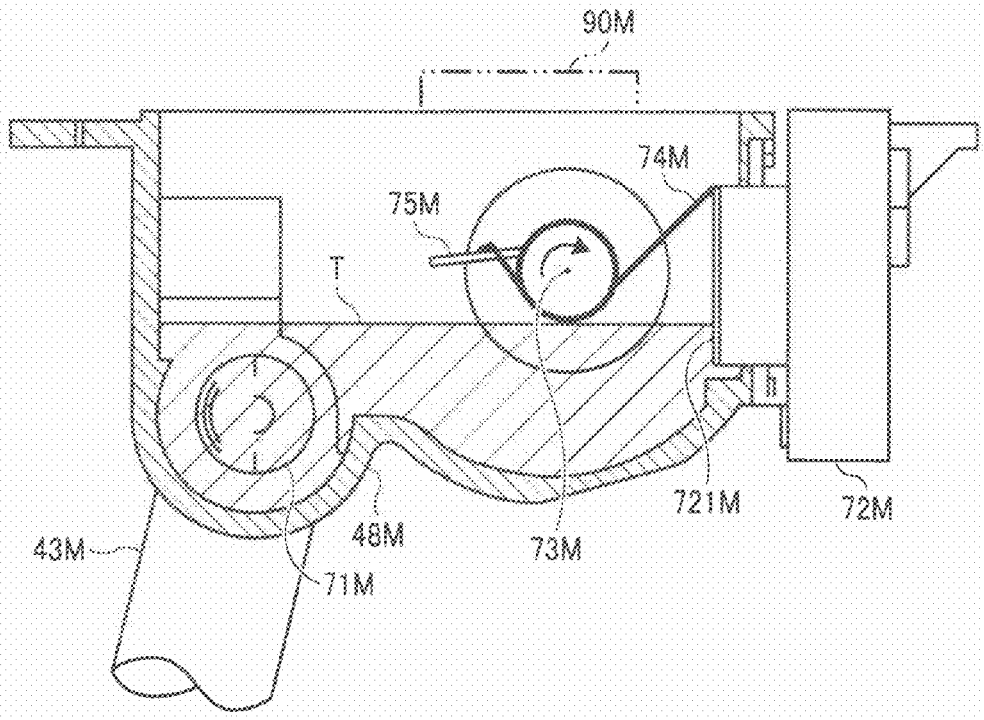
FIG. 22 is a schematic cross-sectional view of the inner portion of the sub hopper when seen through from the front side and illustrating a toner remaining amount in the sub hopper at the time of a toner end notification.
Figure 23:
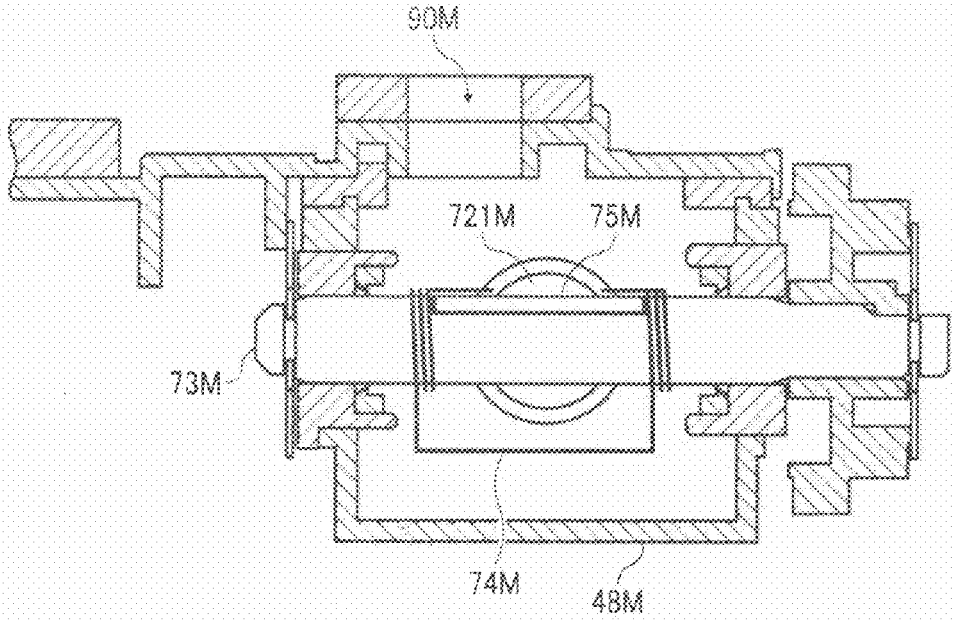
FIG. 23 is a schematic cross-sectional view of the inner portion of the sub hopper when seen through from a left side direction and illustrating a position of a toner replenishing port.
Figure 24:
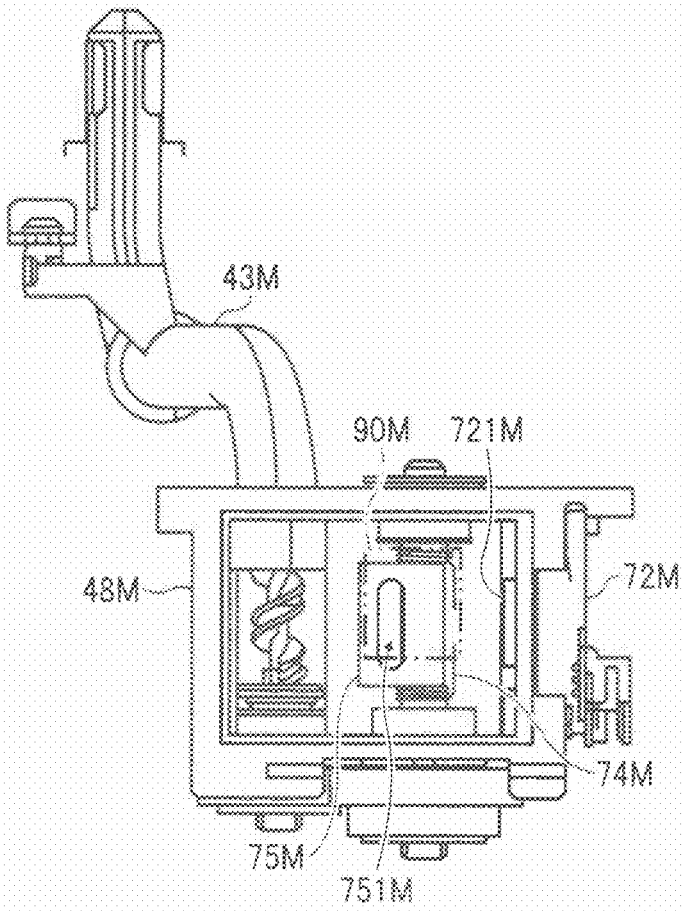
FIG. 24 is a schematic top view of the inner portion of the sub hopper when seen from the above and illustrating the position of the toner replenishing port.

FIG. 22 is a schematic cross-sectional of an inner portion of the sub hopper 48M when seen through from the front side and illustrating a toner remaining amount in the sub hopper 48M at the time of the toner end notification. Furthermore, FIG. 23 is a schematic cross-sectional view of the inner portion of the sub hopper 48M when seen through from a left side direction. FIG. 24 is a schematic top view of the inner portion of the sub hopper 48M when seen from the above. FIG. 22 through FIG. 24 illustrate a position of a toner replenishing port 90M.

As illustrated in FIG. 22, it is desirable that toner of approximately an amount illustrated by a shaded area remains in the sub hopper 48M at the time of the toner end notification to reduce the following risk in the replenishing device 40M according to the embodiment. That is, there arises a risk that if a new toner (fluidized toner) flows into the sub hopper 48M from the toner replenishing port 90M in a state where developer in the sub hopper 48M is reduced to the extent that the developer is not present on an opening 481M (see FIG. 11) of the toner conveying pipe 43M, the toner flows into the toner conveying pipe 43M at once and excessive toner is supplied to the developing unit 6M. Therefore, it is desirable that the toner detection sensor 72M is provided at a position where the toner detection sensor 72M detects whether toner remains on the upper side with respect to the opening 481M of the toner conveying pipe 43M. With such configuration, since the toner detection sensor 72M is provided at an upper portion, toner remaining on the upper portion of the sensor detection surface 721M after toner on the sensor detection surface 721M has been scrapped off by the agitator 74M becomes smaller. Therefore, toner naturally fallen to the front of the sensor detection surface 721M from the upper portion thereof is reduced. However, since toner is collected to the sensor detection surface 721M by the paddle 75M, erroneous detection can be prevented from occurring.

Next, the toner end notification by the toner detection sensor 72M is described.

Figure 25:
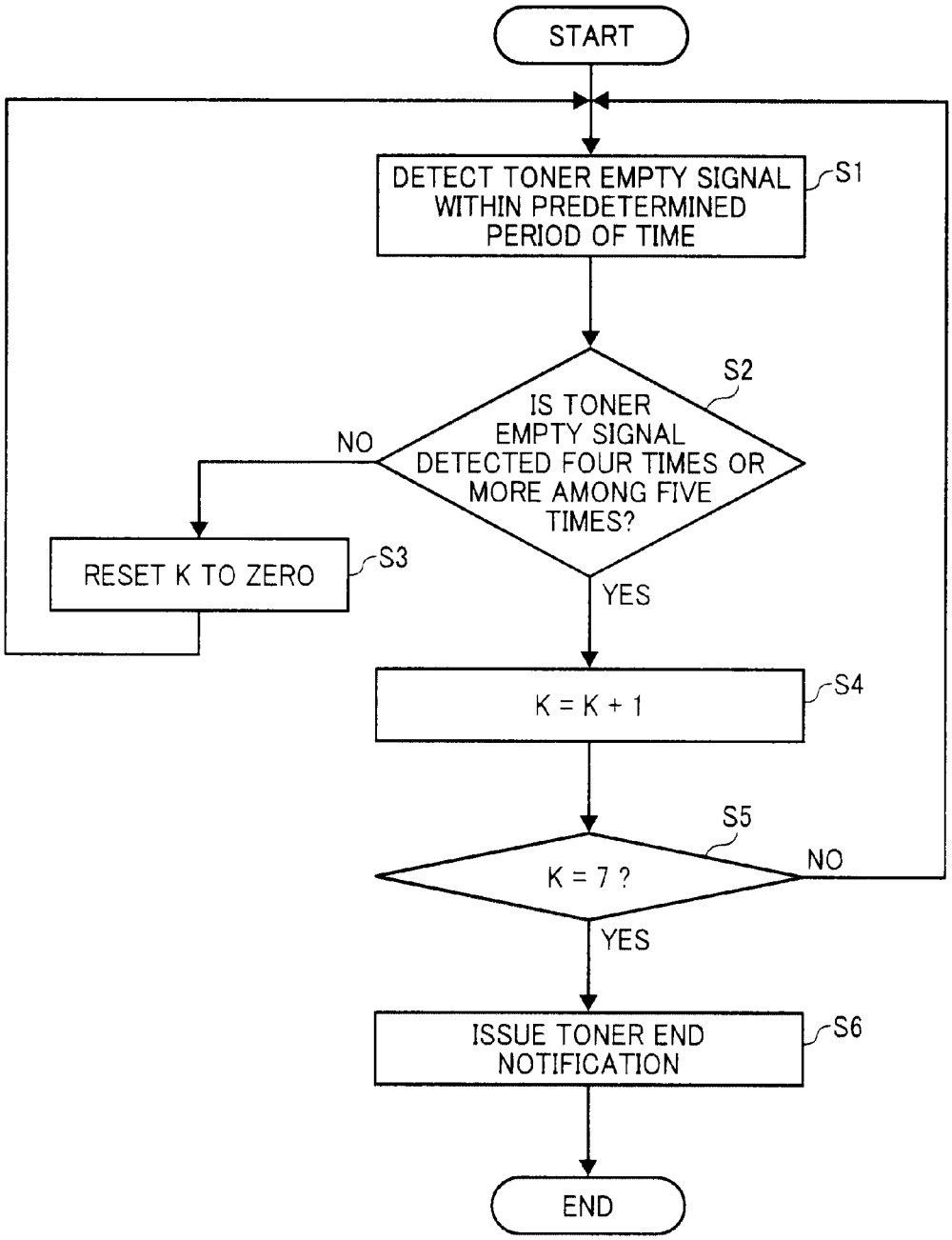
FIG. 25 is a flowchart of one example of a toner remaining amount notification process.

FIG. 25 is a flowchart of an example of the process to issue a toner end notification. A cycle in which the agitator 74M passes through on the sensor detection surface 721M is not identical to a cycle in which the toner detection sensor 72M detects whether toner remains. Therefore, the toner end notification is issued based on results obtained by a plurality of detections.

In FIG. 25, if a toner remaining amount notification control is started, the toner detection sensor 72M detects whether toner in the sub hopper 48M remains every constant time. If the toner does not remain, the toner detection sensor 72M outputs a toner empty signal. Then, the control unit detects the toner empty signal from the toner detection sensor 72M within a predetermined period of time (step S1). It is assumed that the control unit detects the toner empty signal five times within a predetermined period of time when toner does not remain. If the control unit detect the toner empty signal three times or less (No at step S2), the control unit resets a value of a toner empty detection counter K to zero (step S3) and detects the toner empty signal from the toner detection sensor 72M within a predetermined period of time again (step S1). On the other hand, if the control unit detects the toner empty signal four times or more at step S2 (Yes at step S2), 1 is added to a value of the toner empty detection counter K (step S4). Next, it is judged whether a value of the toner empty detection counter K is 7. If the value of the toner empty detection counter K is not 7 (No at step S5), the control unit detects the toner empty signal from the toner detection sensor 72M within a predetermined period of time again (step S1). On the other hand, if the value of the toner empty detection counter K is 7 (Yes at step S5), the control unit issues a toner end notification (step S6). That is, the toner detection sensor 72M detects whether toner remains five times within a predetermined period of time. If it is detected that toner does not remain four times or more, count 1 is added to a value of the toner empty detection counter K. Further, if count 1 is added thereto six times in a continuous manner, it is confirmed that toner does not remain, and the toner end notification is issued.

Although the above embodiment is described as being applied to a configuration in which an agitation driving shaft that rotates the agitator and the paddle and a developer conveying screw are driven by the same driving motor is described, it may also be applied to a configuration in which the agitation driving shaft and the developer conveying screw are driven by different driving motors.

The embodiment may be applied to a so-called one-drum type image forming apparatus in which toner images of each color are sequentially formed on one photosensitive element and are sequentially superimposed on one another to obtain a color image. The embodiment may also be applied to an image forming apparatus capable of forming only a monochrome image.

As described above, according to the above embodiment, the toner replenishing device 40 includes the sub hopper 48 as a toner container that contains toner, the toner detection sensor 72 as a toner detection sensor that is installed on a wall surface in the sub hopper 48 and detects whether toner remains at a height at which the toner detection sensor is installed, and the agitator 74 as a detection surface cleaning member that rotates in the sub hopper 48 to clean the sensor detection surface 721 of the toner detection sensor 72. The toner replenishing device 40 further includes the paddle 75 as a toner collecting unit that collects toner to the vicinity of the sensor detection surface 721 of the toner detection sensor 72 in the sub hopper 48.

According to the embodiment, the paddle 75 is configured to be rotatable. If the paddle 75 rotates, toner in the sub hopper 48 is collected to the sensor detection surface 721 of the toner detection sensor 72. Therefore, a configuration can be made simple.

According to the embodiment, the agitation rotating shaft 73 as a cleaning member driving shaft for rotating the agitator 74 is further included. The paddle 75 is arranged on the agitation rotating shaft 73. The agitator 74 and the paddle 75 are arranged on the same agitation rotating shaft 73. Therefore, a configuration can be made simpler and a device entire body can be made compact.

According to the embodiment, the agitator 74 friction-slides on the sensor detection surface 721 of the toner detection sensor 72. A cleaning area by the agitator 74 is within 1 mm from the sensor detection surface 721 in the direction perpendicular to the sensor detection surface 721. If the cleaning area enlarges such that a distance from the sensor detection surface 721 in the direction perpendicular to the sensor detection surface 721 is larger than 1 mm, toner is excessively agitated and the air is excessively mixed into the toner. This cause a risk that erroneous detection is made. In contrast, if the cleaning area is within 1 mm from the sensor detection surface 721 in the direction perpendicular to the sensor detection surface 721, excessive agitation of toner is suppressed. In addition, a space in the vicinity of the sensor detection surface 721, which is generated at the time of the cleaning, can be made small as much as equal to or smaller than 1 mm. This makes it possible to prevent a state where the amount of toner is small only in the vicinity of the sensor detection surface 721 from being occurred. Therefore, toner is not excessively agitated, and thus the toner detection sensor can accurately detect whether toner remains.

According to the embodiment, the agitator 74 is made of an elastic material. The elastic material is elastically deformed to uniformly clean the sensor detection surface 721. Therefore, toner can be prevented from getting stuck on the sensor detection surface 721.

According to the embodiment, an angle formed by a tip of the agitator 74 and a tip of the paddle 75 on a virtual plane perpendicular to the agitation rotating shaft 73 on the downstream side in the rotational direction of the agitator 74 is larger than 0° and equal to or smaller than 180°. At this time, an axis core of the agitation rotating shaft 73 when the agitator 74 cleans the sensor detection surface 721 is set as a center. After the agitator 74 has cleaned the sensor detection surface 721, the paddle 75 passes through the vicinity of the sensor detection surface 721 until the agitation rotating shaft 73 at least half rotates. Therefore, a space generated when the agitator 74 has cleaned the sensor detection surface 721 can be filled with toner by the paddle 75 immediately.

According to the embodiment, when the paddle 75 comes closest to the sensor detection surface 721, a distance between the paddle 75 and the sensor detection surface 721 is larger than 0 mm and equal to or smaller than 2 mm. Therefore, toner is supplied to a space generated immediately after the agitator 74 has cleaned the sensor detection surface 721 to fill the space with toner. Therefore, a state where the amount of toner is small only in the vicinity of the sensor detection surface 721 can be prevented from being occurred and it can be accurately detected whether toner remains. In contrast, when the paddle 75 comes closest to the sensor detection surface 721, if the distance between the paddle 75 and the sensor detection surface 721 is larger than 2 mm, sufficient toner cannot be supplied to a space generated immediately after the agitator 74 has cleaned the sensor detection surface 721. Therefore, the space cannot be completely filled with toner. Accordingly, a state where there is no toner only in the vicinity of the sensor detection surface 721 is occurred and there is a risk that the erroneous detection occurs.

According to the embodiment, the paddle 75 is a plate-like form and an opening is provided on the paddle 75. Therefore, if the paddle 75 rotates, toner passes through from the opening. Therefore, toner can be suppressed from being excessively agitated.

In addition, according to the embodiment, the agitator 74 is wider in the axial line direction of the agitation rotating shaft 73 than the sensor detection surface 721. Therefore, the sensor detection surface 721 is entirely cleaned by the agitator 74 and toner can be prevented from getting stuck on the sensor detection surface 721.

According to the embodiment, the paddle 75 is wider in the axial line direction of the agitation rotating shaft 73 than the sensor detection surface 721. Therefore, toner can be supplied to the space generated immediately after the agitator 74 has cleaned the sensor detection surface 721 by the paddle 75. At this time, toner can be supplied to the vicinity of the entire of the sensor detection surface 721. Accordingly, a state where the amount of toner is small only in the vicinity of the sensor detection surface 721 can be prevented from being occurred and it can be accurately detected whether toner remains.

According to the embodiment, a toner conveying screw in the toner conveying pipe 43 as a toner replenishing conveying member that rotates to replenish toner to the developer container 54 from the sub hopper 48 is included. Driving force is transmitted to the agitator 74 and the toner conveying screw from the driving motor 41 as a common toner replenishing operation driving source. To increase image formation speed, the number of revolutions of the toner conveying screw is increased. Even if the number of revolutions of the agitator 74 provided on the agitation rotating shaft 73 is increased along with the increase in the number of revolutions of the toner conveying screw, a space generated when the agitator 74 cleans the sensor detection surface 721 can be filled with toner by the paddle 75 immediately. Therefore, erroneous detection by the toner detection sensor 72 can be prevented from occurring.

According to an aspect of the invention, even if the level of toner to be detected becomes lower or a space is formed between the detection surface and the toner to be detected by cleaning the detection surface of the toner detection sensor by the detection surface cleaning member, the toner collecting member collects toner to the vicinity of the detection surface. Accordingly, the lowered toner level can be made to an original level or the space can be filled with toner. Therefore, in particular, when the toner detection sensor detects a toner remaining amount in the toner container of which capacity is smaller than that of the conventional one, erroneous detection that the toner detection sensor detects that toner does not remain although toner remains sufficiently can be prevented. Therefore, a toner remaining amount can be accurately detected.

That is, when the detection surface of the toner detection sensor that detects a toner remaining amount in the toner container is cleaned, even when the capacity of the toner container is smaller than the conventional one, the toner remaining amount can be detected accurately.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner replenishing device comprising:

a toner container that contains toner;

a toner detection sensor that is located on a wall surface of the toner container and detects whether the toner remains at a height at which the toner detection sensor is located;

a detection surface cleaning member that is rotatable in the toner container to make contact with and clean a detection surface of the toner detection sensor; and a toner collecting unit that moves a portion of the toner to a vicinity of the detection surface of the toner detection sensor in the toner container, wherein the toner collecting unit does not contact the detection surface, wherein the detection surface cleaning member is formed by an elastic wire, wherein the toner collecting unit is planar, wherein when the detection surface cleaning member slides on the detection surface of the toner detection sensor, an angle θ between the detection surface cleaning member and the toner collecting unit satisfies $0° < \theta < 90°$, and wherein the angle θ is formed between the detection surface cleaning member and the toner collecting unit in the rotational direction.

2. The toner replenishing device according to claim 1, wherein the toner collecting unit includes a rotatable toner collecting member, wherein the toner collecting member is different from the detection surface cleaning member.

3. The toner replenishing device according to claim 2, further comprising a cleaning member driving shaft configured to rotate the detection surface cleaning member, wherein the toner collecting member is arranged on the cleaning member driving shaft.

4. The toner replenishing device according to claim 3, wherein, on a virtual plane perpendicular to the cleaning member driving shaft, with a center of the cleaning member driving shaft when the detection surface cleaning member cleans the detection surface as a center point, an angle formed by a line connecting a tip of the detection surface cleaning member to the center point and a line connecting a tip of the toner collecting member on a downstream side in a rotational direction of the detection surface cleaning member to the center point is larger than 0° and equal to or smaller than 180°.

5. The toner replenishing device according to claim 3, wherein the detection surface cleaning member is wider in an axial line direction of the cleaning member driving shaft than the detection surface.

6. The toner replenishing device according to claim 3, wherein the toner collecting member is wider in an axial line direction of the cleaning member driving shaft than the detection surface.

7. The toner replenishing device according to claim 2, wherein a distance between the toner collecting member coming closest to the detection surface and the detection surface is larger than 0 millimeters and equal to or smaller than 2 millimeters.

8. The toner replenishing device according to claim 2, wherein the toner collecting member is a plate-like paddle, and an opening is provided on the plate-like paddle.

9. The toner replenishing device according to claim 1, wherein the detection surface cleaning member slides on the detection surface of the toner detection sensor, and the detection surface cleaning member cleans an area within 1 millimeter from the detection surface in a direction perpendicular to the detection surface.

10. The toner replenishing device according to claim 1, further comprising a toner replenishing conveying member that is rotatable to replenish toner to a developer container, wherein driving force is transmitted to the detection surface cleaning member and the toner replenishing conveying member from a common toner replenishing operation driving source.

11. The toner replenishing device according to claim 1, the elastic wire is one of a hard steel wire, a piano wire, and a spring stainless steel line.

12. The toner replenishing device according to claim 1, the detection surface cleaning member is formed by a double torsion spring.

13. The toner replenishing device according to claim 12, the double torsion spring is formed by coupling two torsion coil springs to each other and is capable of receiving a torsion moment about an axial line of the two torsion coil springs.

14. An image forming apparatus comprising:

a latent image carrier;

a developing unit that develops a latent image on the latent image carrier with a developer in a developer container; and a toner replenishing device that supplies toner to the developer container, and includes a toner container that contains the toner;

a toner detection sensor that is located on a wall surface of the toner container and detects whether the toner remains at a height at which the toner detection sensor is located;

a detection surface cleaning member that is rotatable in the toner container to make contact with and clean a detection surface of the toner detection sensor; and a toner collecting unit that moves a portion of the toner to the vicinity of the detection surface of the toner detection sensor in the toner container, wherein the toner collecting unit does not contact the detection surface, wherein the detection surface cleaning member is formed by an elastic wire, wherein the toner collecting unit is planar, wherein when the detection surface cleaning member slides on the detection surface of the toner detection sensor, an angle $\theta$ between the detection surface cleaning member and the toner collecting unit satisfies $0° < \theta < 90°$, and wherein the angle $\theta$ is formed between the detection surface cleaning member and the toner collecting unit in the rotational direction.

* * * * *